US006811248B2

(12) United States Patent
Matsuo et al.

(10) Patent No.: US 6,811,248 B2
(45) Date of Patent: Nov. 2, 2004

(54) INK JET HEAD, METHOD OF MANUFACTURING THE SAME AND INK JET RECORDING APPARATUS

(75) Inventors: Hiroyuki Matsuo, Osaka (JP); Koji Ikeda, Hyogo (JP); Atsushi Sogami, Hyogo (JP); Masaichiro Tatekawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 126 days.

(21) Appl. No.: 10/349,920

(22) Filed: Jan. 24, 2003

(65) Prior Publication Data

US 2003/0112301 A1 Jun. 19, 2003

Related U.S. Application Data

(62) Division of application No. 09/903,205, filed on Jul. 11, 2001, now Pat. No. 6,565,196.

(30) Foreign Application Priority Data

Jul. 11, 2000 (JP) ..... 2000-209408
Jan. 22, 2001 (JP) ..... 2001-013089

(51) Int. Cl.[7] ..... B41J 2/045
(52) U.S. Cl. ..... 347/68
(58) Field of Search ..... 347/60, 68, 69, 347/70, 71, 72; 29/25.35

(56) References Cited

U.S. PATENT DOCUMENTS 4,825,227 A 4/1989 Fischbeck et al.
5,617,127 A 4/1997 Takeuchi et al.
5,790,155 A * 8/1998 Usui et al. ..... 347/68
5,912,679 A 6/1999 Takayama et al.
5,997,134 A 12/1999 Hotomi et al.
6,142,615 A 11/2000 Que et al.
6,176,570 B1 * 1/2001 Kishima et al. ..... 347/70

FOREIGN PATENT DOCUMENTS

EP 0838336 A2 4/1998
EP 0 877 430 A2 11/1998
EP 0 930 165 A1 7/1999
JP 10286953 A 10/1988
JP 11348285 A 12/1999

OTHER PUBLICATIONS

Office Action from State Intellectual Property Office of People's Republic of China for Application No. 01120046.4; Issued Feb. 27, 2004.

* cited by examiner

*Primary Examiner*—Anh T. N. Vo
(74) *Attorney, Agent, or Firm*—Harness, Dickey & Pierce, P.L.C.

(57) ABSTRACT

A plurality of actuator blocks having a vibration plate, a common electrode, a piezoelectric element, and a separate electrode, are produced, and the plurality of actuator blocks are transferred onto a single pressure chamber plate. The actuator blocks are arranged in a zigzag pattern so that adjacent actuator blocks are spaced apart from each other in the scanning direction while partially overlapping with each other with respect to the head width direction.

50 Claims, 15 Drawing Sheets

INK JET HEAD, METHOD OF MANUFACTURING THE SAME AND INK JET RECORDING APPARATUS

This application is a divisional of application Ser. No. 09/903,205, filed on Jul. 11, 2001, now U.S. Pat. No. 6,565,196 the entire contents of which are hereby incorporated by reference and for which priority is claimed under 35 U.S.C. §120; and this application claims priority of Japanese application No. 2000-209,408 tiled Jul. 11, 2000 and Japanese Application No. 2001-013,089 filed Jan. 22, 2001 under U.S.C. §119.

FIELD OF THE INVENTION

The present invention relates to an ink jet head, a method of manufacturing the same, and an ink jet recording apparatus.

BACKGROUND OF THE INVENTION

In recent years, ink jet heads having densely arranged nozzles that are produced by using a so-called "transfer process" are known in the art, as disclosed in, for example, Japanese Laid-Open Patent Publication No. 10-286953. A transfer process is an advantageous process as a method of producing a high-density print head. In a transfer process, first, a thin film actuator is produced as follows, for example. That is, a separate electrode is formed on a substrate made of single crystal MgO, or the like, and then a perovskite-type dielectric thin film made of PZT is formed as a piezoelectric member on the separate electrode. Moreover, a vibration plate that functions also as a common electrode is formed on the piezoelectric member by a method such as sputtering. Then, the thus produced actuator is attached to a pressure chamber plate, and the whole or part of the substrate is thereafter removed.

However, it was difficult to produce a line type ink jet head with the transfer process as described above for the following reasons.

In a line type ink jet head, the length of the ink jet head in the width direction (i.e., the longitudinal direction of the ink jet head) needs to be greater than the paper width of the recording paper. For example, in order to record information on A4-size paper, the length of the ink jet head in the width direction needs to be 210 mm or more. Therefore, the length of the single crystal MgO substrate in the longitudinal direction thereof also needs to be 210 mm or more. A single crystal MgO substrate is produced from a rock lump of MgO. However, the entire rock lump cannot be used, but what can actually be used is only a portion thereof. Therefore, in order to produce a single crystal MgO substrate whose length is 210 mm or more, it is necessary to provide a lump of MgO of such a length, thereby requiring very large equipment. Even if such a single crystal MgO substrate can be produced, it will be a very costly material because of a poor yield.

Moreover, in a transfer process, it is necessary to deposit, by sputtering, or the like, a piezoelectric element (e.g., PZT, etc.) on a substrate made of single crystal MgO, or the like. However, it requires very large equipment to deposit PZT over a large area. In addition, the yield lowers when one attempts to obtain a piezoelectric element film that is uniform in properties such as the piezoelectric property and the thickness and that has no crack therein. Therefore, the manufacturing cost becomes very high.

For the reasons as described above, it was difficult to use a transfer process for a conventional line type ink jet head in view of the quality and the cost.

An object of the present invention is to provide a high-density print head and a recording apparatus incorporating the same, with various advantages, including an improved uniformity of the thin film actuator in terms of properties such as the piezoelectric property and the thickness, prevention of a crack occurring in the film, improvement in the manufacturing yield, downsizing of the manufacturing equipment, a cost reduction, etc.

SUMMARY OF THE INVENTION

In the present invention, a plurality of actuator blocks including piezoelectric elements, etc., are provided for each pressure chamber plate, with the size of each actuator block being reduced.

A first ink jet head of the present invention is an ink jet head including: a plurality of actuator blocks each having at least a plurality of piezoelectric elements, and a first electrode and a second electrode for applying a voltage across each of the piezoelectric elements; and a pressure chamber block having therein a plurality of pressure chambers each containing an ink, the actuator blocks and the pressure chamber block being layered on each other, wherein: an area of a layering surface of each of the actuator blocks is smaller than an area of a layering surface of the pressure chamber block; and the plurality of actuator blocks are arranged on one surface of the pressure chamber block.

A second ink jet head is the first ink jet head, wherein the pressure chamber block includes: a pressure chamber plate having therein the plurality of pressure chambers each containing an ink; a channel plate having therein a plurality of ink channels respectively communicated to the pressure chambers and a common liquid chamber communicated to the pressure chambers; and a nozzle plate having therein a plurality of nozzles respectively communicated to the ink channels, the pressure chamber plate, the channel plate and the nozzle plate being layered on one another.

A third ink jet head is the first ink jet head, wherein the plurality of actuator blocks are arranged so that edge surfaces of ones of the actuator blocks adjacent to each other in a direction perpendicular to a scanning direction are not in contact with each other.

A fourth ink jet head is the first ink jet head, wherein the plurality of actuator blocks are arranged so as to be separated from one another so that adjacent ones of the actuator blocks partially overlap with each other with respect to a direction perpendicular to a scanning direction.

A fifth ink jet head is the first ink jet head, wherein the plurality of actuator blocks are arranged so that adjacent ones of the actuator blocks are spaced apart from each other in a scanning direction.

A sixth ink jet head is the first ink jet head, wherein the plurality of actuator blocks are arranged in a staggered pattern.

A seventh ink jet head is the first ink jet head, wherein the actuator blocks include, instead of the second electrode, a conductive vibration plate functioning also as the second electrode.

An eighth ink jet head is the second ink jet head, wherein: the nozzle plate is made of a single plate; and one or both of the pressure chamber plate and the channel plate includes alignment means for aligning the nozzle plate when the nozzle plate is layered on the channel plate.

Note that the alignment means includes various means such as, for example, an alignment hole or an optically-detected alignment marker.

A ninth ink jet head is the second ink jet head, wherein: the nozzle plate is made of a plurality of plates; and one or both of the pressure chamber plate and the channel plate includes alignment means for aligning the nozzle plates when the nozzle plates are layered on the channel plate.

A tenth ink jet head is the second ink jet head, wherein the ink jet head is obtained by producing an actuator block by sequentially layering at least the first electrode, the piezoelectric element, and the second electrode, on a substrate having a smaller area than that of the pressure chamber plate, and then transferring the actuator block onto the pressure chamber plate so that the plurality of pressure chambers provided in the pressure chamber plate are covered by the second electrode.

An eleventh ink jet head is the tenth ink jet head, wherein the substrate is an MgO single crystal substrate, and the piezoelectric element is produced by sputtering.

A twelfth ink jet head is the tenth ink jet head, wherein the substrate is an MgO single crystal substrate.

A thirteenth ink jet head is the tenth ink jet head, wherein the piezoelectric element is produced by sputtering.

A fourteenth ink jet head is the second ink jet head, wherein the ink jet head is obtained by producing an actuator block by sequentially layering at least the first electrode, the piezoelectric element, the second electrode, and a vibration plate, on a substrate having a smaller area than that of the pressure chamber plate, and then transferring the actuator block onto the pressure chamber plate so that the plurality of pressure chambers provided in the pressure chamberplate are covered by the vibration plate.

A fifteenth ink jet head is the fourteenth ink jet head, wherein the substrate is an MgO single crystal substrate, and the piezoelectric element is produced by sputtering.

A sixteenth ink jet head is the fourteenth ink jet head, wherein the substrate is an MgO single crystal substrate.

A seventeenth ink jet head is the fourteenth ink jet head, wherein the piezoelectric element is produced by sputtering.

An eighteenth ink jet head is an ink jet head including: a plurality of actuator blocks each having at least a plurality of piezoelectric elements, and a first electrode and a second electrode for applying a voltage across each of the piezoelectric elements; and a pressure chamber block having therein a plurality of pressure chambers respectively containing a plurality of types of ink, the actuator blocks and the pressure chamber block being layered on each other, wherein: an area of a layering surface of each of the actuator blocks is smaller than an area of a layering surface of the pressure chamber block; and the plurality of actuator blocks are arranged on one surface of the pressure chamber block.

A nineteenth ink jet head is the eighteenth ink jet head, wherein the pressure chamber block includes: a pressure chamber plate having therein a plurality of pressure chambers respectively containing a plurality of types of ink; a channel plate having therein a plurality of ink channels respectively communicated to the pressure chambers for the respective types of ink and a plurality of common liquid chambers respectively containing the types of ink and respectively communicated to the pressure chambers for the respective types of ink; and a nozzle plate having therein a plurality of nozzles respectively communicated to the ink channels for the respective types of ink, the pressure chamber plate, the channel plate and the nozzle plate being layered on one another.

A twentieth ink jet head is the nineteenth ink jet head, wherein the pressure chamber plate is made of a single plate.

A twenty-first ink jet head is the eighteenth ink jet head, wherein the plurality of types of ink include a black ink, a cyan ink, a magenta ink and a yellow ink.

A twenty-second ink jet head is the eighteenth ink jet head, wherein the plurality of actuator blocks are arranged so that edge surfaces of ones of the actuator blocks adjacent to each other in a direction perpendicular to a scanning direction are not in contact with each other.

A twenty-third ink jet head is the eighteenth ink jet head, wherein the plurality of actuator blocks are arranged so as to be separated from one another so that adjacent ones of the actuator blocks partially overlap with each other with respect to a direction perpendicular to a scanning direction.

A twenty-fourth ink jet head is the eighteenth ink jet head, wherein the plurality of actuator blocks are arranged so that adjacent ones of the actuator blocks are spaced apart from each other in a scanning direction.

A twenty-fifth ink jet head is the eighteenth ink jet head, wherein the plurality of actuator blocks are arranged in a staggered pattern.

A twenty-sixth ink jet head is an ink jet head including: a plurality of actuator blocks each having at least a plurality of piezoelectric elements, and a first electrode and a second electrode for applying a voltage across each of the piezoelectric elements; and a pressure chamber block having therein a plurality of pressure chambers respectively containing a plurality of types of ink, wherein the pressure chambers for the respective types of ink are successively arranged in a scanning direction, the actuator blocks and the pressure chamber block being layered on each other, wherein: an area of a layering surface of each of the actuator blocks is smaller than an area of a layering surface of the pressure chamber block; and the plurality of actuator blocks are arranged on one surface of the pressure chamber block so that each of the actuator blocks covers the pressure chambers for a plurality of types of ink.

A twenty-seventh ink jet head is the twenty-sixth ink jet head, wherein the pressure chamber block includes: a pressure chamber plate having therein a plurality of pressure chambers respectively containing a plurality of types of ink, wherein the pressure chambers for the respective types of ink are successively arranged in the scanning direction; a channel plate having therein a plurality of ink channels respectively communicated to the pressure chambers for the respective types of ink and a plurality of common liquid chambers respectively containing the types of ink and respectively communicated to the pressure chambers for the respective types of ink; and a nozzle plate having therein a plurality of nozzles respectively communicated to the ink channels for the respective types of ink, the pressure chamber plate, the channel plate and the nozzle plate being layered on one another.

A twenty-eighth ink jet head is the twenty-sixth ink jet head, wherein the plurality of types of ink include a black ink, a cyan ink, a magenta ink and a yellow ink.

A twenty-ninth ink jet head is the twenty-sixth ink jet head, wherein the plurality of actuator blocks are arranged so that edge surfaces of ones of the actuator blocks adjacent to each other in a direction perpendicular to a scanning direction are not in contact with each other.

A thirtieth ink jet head is the twenty-sixth ink jet head, wherein the plurality of actuator blocks are arranged so as to be separated from one another so that adjacent ones of the actuator blocks partially overlap with each other with respect to a direction perpendicular to the scanning direction.

A thirty-first ink jet head is the twenty-sixth ink jet head, wherein the plurality of actuator blocks are arranged so that adjacent ones of the actuator blocks are spaced apart from each other in a scanning direction.

A thirty-second ink jet head is the twenty-sixth ink jet head, wherein the plurality of actuator blocks are arranged in a staggered pattern.

A thirty-third ink jet head is an ink jet head including: a plurality of actuator blocks each having at least a plurality of piezoelectric elements, and a first electrode and a second electrode for applying a voltage across each of the piezoelectric elements; and a pressure chamber block having therein a plurality of pressure chambers each containing an ink, a plurality of nozzles, a plurality of ink channels for guiding the ink in the pressure chambers to the nozzles, respectively, and a common liquid chamber communicated to the plurality of pressure chambers, the actuator blocks and the pressure chamber block being layered on each other, wherein: an area of a layering surface of each of the actuator blocks is smaller than an area of a layering surface of the pressure chamber block; and the plurality of actuator blocks are arranged on one surface of the pressure chamber block.

A first ink jet recording apparatus of the present invention is an ink jet recording apparatus for recording information using a plurality of colors of ink, including: a plurality of the first ink jet heads independently provided for the respective colors of ink; and movement means for relatively moving the ink jet heads and a recording medium with respect to each other in a scanning direction.

A second ink jet recording apparatus is an ink jet recording apparatus including: the eighteenth ink jet head; and movement means for relatively moving the ink jet head and a recording medium with respect to each other in a scanning direction.

A third ink jet recording apparatus is an ink jet recording apparatus including: the twenty-sixth ink jet head; and movement means for relatively moving the ink jet head and a recording medium with respect to each other in a scanning direction.

A first manufacturing method of the present invention is a method including: a block production step of producing a plurality of actuator blocks by sequentially layering at least a first electrode, a piezoelectric element, and a second electrode, or by sequentially layering at least a first electrode, a piezoelectric element, a second electrode, and a vibration plate, on each of a plurality of substrates each having a smaller area than that of a pressure chamber plate; a first attachment step of attaching the actuator blocks layered on the respective substrates to one surface of the pressure chamber plate so that some of a plurality of pressure chambers provided in the pressure chamber plate are covered by the second electrode or the vibration plate of each of the actuator blocks; a step of removing the substrates; and a step of patterning the first electrode of each of the actuator blocks.

A second manufacturing method is the first manufacturing method including, after the step of patterning the first electrode: a step of attaching a channel plate on the other surface of the pressure chamber plate, the channel plate having therein ink channels for guiding the ink in the pressure chambers to nozzles, respectively, and a common liquid chamber; and a step of attaching a nozzle plate having therein the nozzles to the channel plate.

A third manufacturing method is the first manufacturing method, wherein the first attachment step is a step of attaching the plurality of actuator blocks to be separated from one another so that adjacent ones of the actuator blocks partially overlap with each other with respect to a direction perpendicular to the scanning direction.

A fourth manufacturing method is the first manufacturing method, wherein the first attachment step is a step of arranging the plurality of actuator blocks in a staggered pattern.

A fifth manufacturing method is the first manufacturing method, wherein the substrate is an MgO single crystal substrate.

A sixth manufacturing method is the first manufacturing method, wherein the block production step includes a step of producing the piezoelectric element by sputtering.

A seventh manufacturing method is the first manufacturing method, wherein the block production step includes a step of layering a conductive vibration plate functioning also as the second electrode, instead of layering the second electrode.

A fourth ink jet recording apparatus is an ink jet recording apparatus including: an ink jet head produced by the first manufacturing method; and movement means for relatively moving the ink jet head and a recording medium with respect to each other in a scanning direction.

An eighth manufacturing method is a method including: a block production step of producing a plurality of actuator blocks by sequentially layering at least a first electrode, a piezoelectric element, and a second electrode, or by sequentially layering at least a first electrode, a piezoelectric element, a second electrode, and a vibration plate, on each of a plurality of substrates each having a smaller area than that of a pressure chamber plate; a first attachment step of attaching the actuator blocks layered on the respective substrates to one surface of the pressure chamber plate so that some of a plurality of pressure chambers provided in the pressure chamber plate are covered by the second electrode or the vibration plate of each of the actuator blocks; a step of removing the substrates; a step of patterning the first electrode of each of the actuator blocks; and a step of patterning the piezoelectric element of each of the actuator blocks.

A ninth manufacturing method is the eighth manufacturing method including, after the step of patterning the piezoelectric element: a step of attaching a channel plate on the other surface of the pressure chamber plate, the channel plate having therein ink channels for guiding the ink in the pressure chambers to nozzles, respectively, and a common liquid chamber; and a step of attaching a nozzle plate having therein the nozzles to the channel plate.

A tenth manufacturing method is the eighth manufacturing method, wherein the first attachment step is a step of attaching the plurality of actuator blocks to be separated from one another so that adjacent ones of the actuator blocks partially overlap with each other with respect to a direction perpendicular to the scanning direction.

An eleventh manufacturing method is the eighth manufacturing method, wherein the first attachment step is a step of arranging the plurality of actuator blocks in a staggered pattern.

A twelfth manufacturing method is the eighth manufacturing method, wherein the substrate is an MgO single crystal substrate.

A thirteenth manufacturing method is the eighth manufacturing method, wherein the block production step includes a step of producing the piezoelectric element by sputtering.

A fourteenth manufacturing method is the eighth manufacturing method, wherein the block production step includes a step of layering a conductive vibration plate functioning also as the second electrode, instead of layering the second electrode.

A fifth ink jet recording apparatus is an ink jet recording apparatus including: an ink jet head produced by the eighth manufacturing method; and movement means for relatively moving the ink jet head and a recording medium with respect to each other in a scanning direction.

With the first, eighteenth and thirty-third ink jet heads, and the first and second ink jet recording apparatuses, a plurality of actuator blocks are provided for each pressure chamber block, whereby the size of each actuator block is reduced. Therefore, even when producing a line type ink jet head, it is not necessary to form an actuator block to such a large size substantially equal to the head width. Therefore, there are provided various advantages, including an improved uniformity of the thin film actuator in terms of properties such as the piezoelectric property and the thickness, prevention of a crack occurring in the film, improvement in the manufacturing yield, downsizing of the manufacturing equipment, a cost reduction, etc.

With the second, nineteenth and twenty-seventh ink jet heads, the pressure chamber block can be provided with a simple structure.

With the third, twenty-second and twenty-ninth ink jet heads, actuator blocks adjacent to each other in the direction perpendicular to the scanning direction do not overlap with each other, thereby improving the reliability of the actuators on the pressure chambers located near the edges of the actuator blocks.

With the fourth, twenty-third and thirtieth ink jet heads, and the third and tenth manufacturing methods, since the actuator blocks are arranged so that adjacent actuator blocks partially overlap with each other with respect to the direction perpendicular to the scanning direction (i.e., the head width direction), all the pressure chambers arrayed in the head width direction will be reliably covered by the actuator blocks. Therefore, despite a plurality of actuator blocks are used, the production error and the positioning error thereof can be tolerated to a considerable extent, thereby improving the yield.

With the fifth, twenty-fourth and thirty-first ink jet heads, adjacent actuator blocks are spaced apart from each other in the scanning direction, whereby the actuator blocks will not physically overlap with each other even if the positional precision of the actuator blocks is somewhat low or if the error in the shape of the actuator blocks is somewhat large.

With the sixth, twenty-fifth and thirty-second ink jet heads, and the fourth and eleventh manufacturing methods, the length of the ink jet head in the scanning direction (i.e., the direction perpendicular to the head width direction) decreases.

With the seventh ink jet head, and the seventh and fourteenth manufacturing methods, the number of components is reduced.

With the eighth and ninth ink jet heads, the nozzles are precisely aligned, thereby improving the quality of the ink jet head. Moreover, the yield is also improved.

With the ninth ink jet head, the nozzle plate is used only where it is needed, thereby reducing the cost. Moreover, the number of nozzles to be processed for each nozzle plate is reduced, thereby improving the yield.

With the tenth and fourteenth ink jet heads, effects as those obtained for the first ink jet head can be obtained for an ink jet head that is produced by a transfer process.

With the eleventh, twelfth, thirteenth, fifteenth, sixteenth and seventeenth ink jet heads, and the fifth, sixth, twelfth and thirteenth manufacturing methods, a piezoelectric element having a desirable piezoelectric property can be obtained.

With the twentieth ink jet head, the alignment of the various components can be done with respect to a single pressure chamber plate as a reference, whereby the ink jet head can be produced with a high precision.

With the twenty-first and twenty-eighth ink jet heads, at least four colors of ink are used, and a color image is obtained.

With the twenty-sixth ink jet head, and the third ink jet recording apparatus, each actuator block covers pressure chambers for a plurality of types of ink, whereby the number of actuators included in one actuator block is increased. Therefore, the density of the pressure chambers and the actuators increases. As a result, the ink jet head is downsized and the material cost is reduced.

With the first and second manufacturing methods, and the fourth ink jet recording apparatus, there are provided various advantages, including an improved uniformity of the thin film actuator in terms of properties such as the piezoelectric property and the thickness, prevention of a crack occurring in the film, improvement in the manufacturing yield, downsizing of the manufacturing equipment, a cost reduction, etc.

With the eighth and ninth manufacturing methods, and the fifth ink jet recording apparatus, not only the first electrode but also the piezoelectric element is patterned, whereby the actuator becomes more flexible. Accordingly, the voltage required for causing a predetermined flexural deformation in the actuator can be reduced. Therefore, it is possible to produce a power-conservative ink jet head.

As described above, according to the present invention, an actuator is formed by a plurality of actuator blocks, and the plurality of actuator blocks are provided for a pressure chamber plate, whereby the size of each actuator block can be reduced. Therefore, there are provided various advantages, including an improved uniformity of the thin film actuator in terms of properties such as the piezoelectric property and the thickness, prevention of a crack occurring in the film, improvement in the manufacturing yield, downsizing of the manufacturing equipment, a cost reduction, etc.

Moreover, since the plurality of actuator blocks are arranged so that they do not contact one another but partially overlap with one another with respect to the head width direction, the production error and the arrangement error of the actuator blocks can be tolerated to a considerable extent, thereby further improving the yield.

DESCRIPTION OF THE PREFERRED EMBODIMENTS

Embodiments of the present invention will now be described with reference to the drawings.

Embodiment 1

Figure 1:
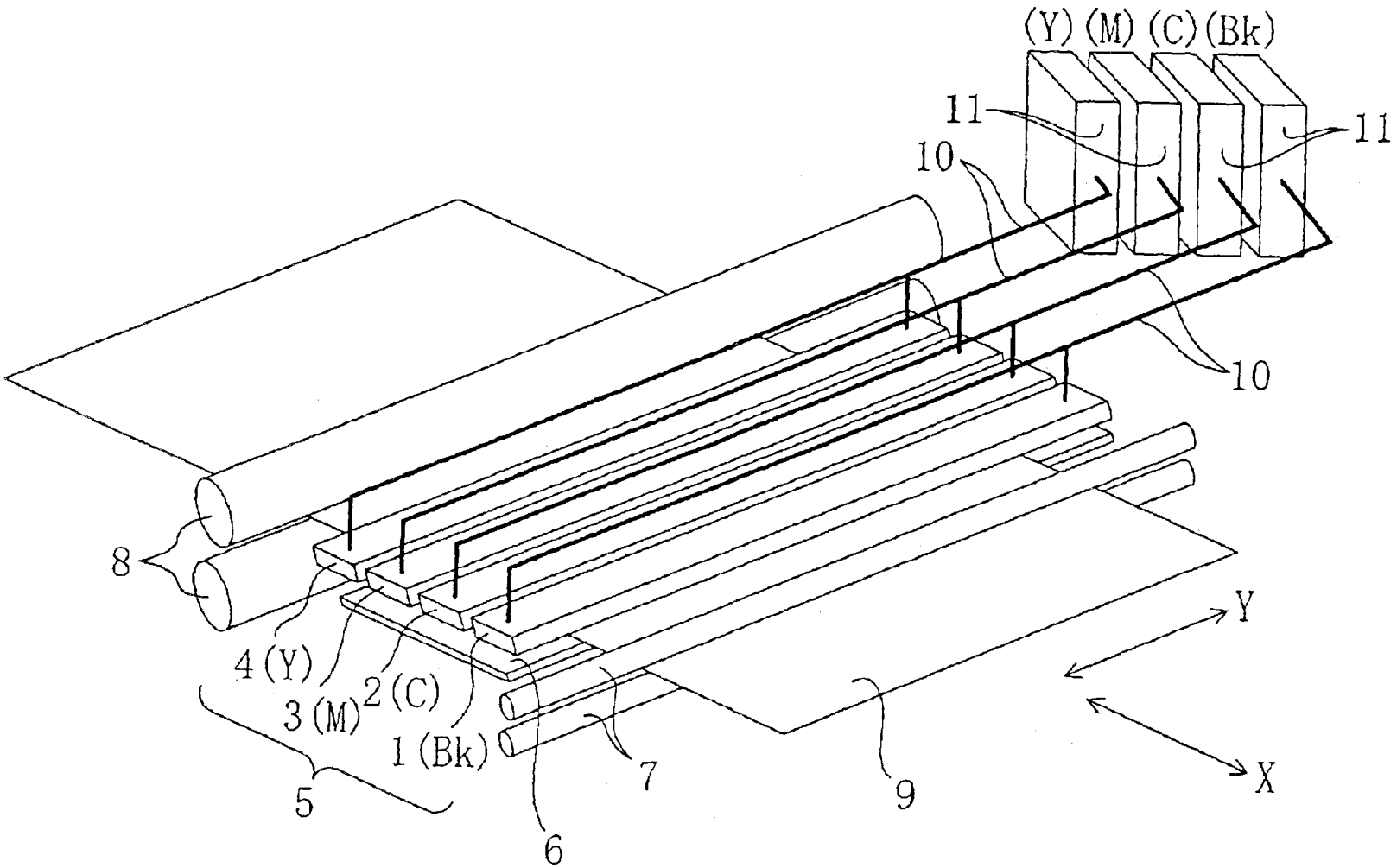
FIG. 1 is a schematic perspective view illustrating a recording apparatus according to Embodiment 1.

FIG. 1 is a schematic perspective view illustrating an ink jet recording apparatus including a plurality of independent line heads independently formed for respective inks of different colors. Reference numeral 1 is a first line head for, discharging a black ink (Bk), 2 is a second line head for discharging a cyan ink (C), 3 is a third line head for discharging a magenta ink (M), and 4 is a fourth line head for discharging a yellow ink (Y). A line head 5 is obtained by assembling together the first to fourth line heads 1 to 4 so that the black, cyan, magenta and yellow inks are discharged in this order. The inks are respectively supplied to the line heads 1 to 4 through ink tubes 10 connected to ink tanks 11.

A recording medium 9 is carried by carrier rollers 8 in a carry direction X perpendicular to a head width direction Y. The carry direction X coincides with the scanning direction. A recording medium holding member 6 for holding the recording medium 9 is provided below the line head 5. The recording medium 9 is placed under a tension by the carrier rollers 8 and feeding rollers 7, and makes a flat surface on the recording medium holding member 6 by using the tension. Note that although not shown, the recording medium 9 on the recording medium holding member 6 can be made even flatter by electrically attracting the recording medium 9 by giving an electrostatic charge to the recording medium holding member 6. Then, ink droplets discharged from the line head 5 precisely strike the striking positions on the recording medium 9. Thus, means for giving an electrostatic charge to the recording medium holding member 6 may be provided.

Figure 2:
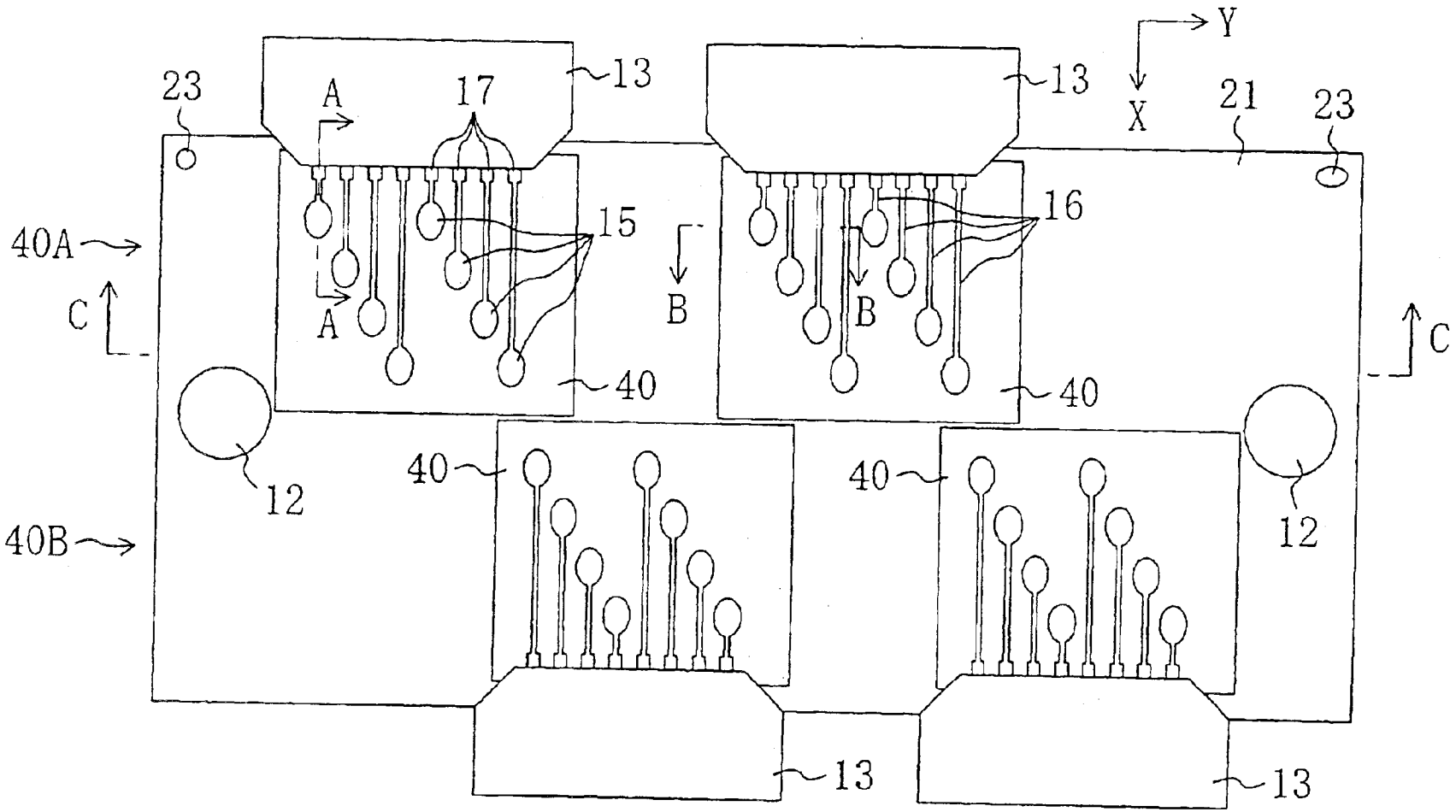
FIG. 2 is a plan view illustrating one line head.
Figure 3A:
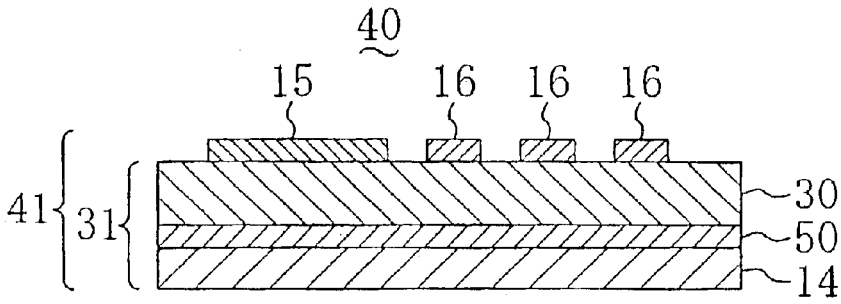
FIG. 3A to FIG. 3D are each a cross-sectional view taken along line B—B of FIG. 2.

The structure of each line head will be described with reference to FIG. 2 and FIG. 3A. FIG. 2 is a plan view illustrating a line head of one color (i.e., one of the first to fourth line heads 1 to 4). FIG. 3A is a cross-sectional view illustrating an actuator block 40, and specifically a cross-sectional view taken along line B—B of FIG. 2. As illustrated in FIG. 2, a plurality of actuator blocks 40, 40, . . . , are arranged on a pressure chamber plate 21 made of SUS (stainless steel), Si, a photosensitive glass, etc. The actuator blocks 40, 40, . . . , are arranged so that they do not contact one another and so that adjacent actuator blocks partially overlap with one another with respect to the head width direction Y. They are arranged in a so-called "staggered pattern". In other words, they are arranged in a zigzag pattern.

More specifically, a first block column 40A and a second block column 40B are formed on the pressure chamber plate 21. Each of the first block column 40A and the second block column 40B is formed by a plurality of actuator blocks 40, 40, . . . , arranged at regular intervals in the head width direction (the Y direction). The first block column 40A and the second block column 40B are arranged in the recording medium carrying direction (the X direction). The actuator blocks 40 and 40 belonging to the same block column are separated from each other in the head width direction Y. The actuator block 40 belonging to the first block column 40A and the actuator block 40 belonging to the second block column 40B are separated from each other in the carry direction X. The actuator block 40 of the first block column 40A and the actuator block 40 of the second block column 40B are provided at positions shifted from each other with respect to the head width direction Y. For example, the actuator block 40 of the first block column 40A is positioned between the actuator blocks 40 and 40 of the second block column 40B with respect to the head width direction Y.

The actuator block 40 is provided with a piezoelectric element 30 (see FIG. 3A). The piezoelectric element 30 is formed by a perovskite-type dielectric thin film having a thickness of 0.5 $\mu$m to 5 $\mu$m and made of PZT. First electrodes 15 for providing potentials individually, conductive lead sections 16 made of Pt, or the like, having a thickness of about 0.1 $\mu$m for supplying a voltage to the first electrodes 15, and input terminals 17 connected to an FPC 13, are arranged on the surface of each piezoelectric element 30. Note that the first electrode 15 is made of a conductive material such as Pt having a thickness of about 0.1 $\mu$m. The pressure chamber plate 21 is provided with an ink tube port 12 for introducing an ink therethrough from the ink tube 10.

As illustrated in FIG. 3A, in the actuator block 40, a second electrode 50 made of a conductive material such as Pt, Cu or Ti is layered on a vibration plate 14 made of nickel, chrome or an oxide of silicon, or ceramics, etc. The second electrode 50 is a common electrode for giving a common potential to each piezoelectric element 30 in the actuator block 40. The piezoelectric element 30 is layered on the second electrode 50, and the first electrodes 15 and the lead sections 16 are layered on the piezoelectric element 30. The vibration plate 14, the second electrode 50 and the piezoelectric element 30 together form an actuator plate 31. Moreover, the actuator plate 31 and the first electrode 15 together form an actuator 41 for increasing or decreasing the volume of the pressure chamber so as to discharge the ink in the pressure chamber. Note that in order to allow for high density arrangement of the actuators 41, it is preferred that the thickness of the actuator 41 is 8 $\mu$m or less.

Figure 4:
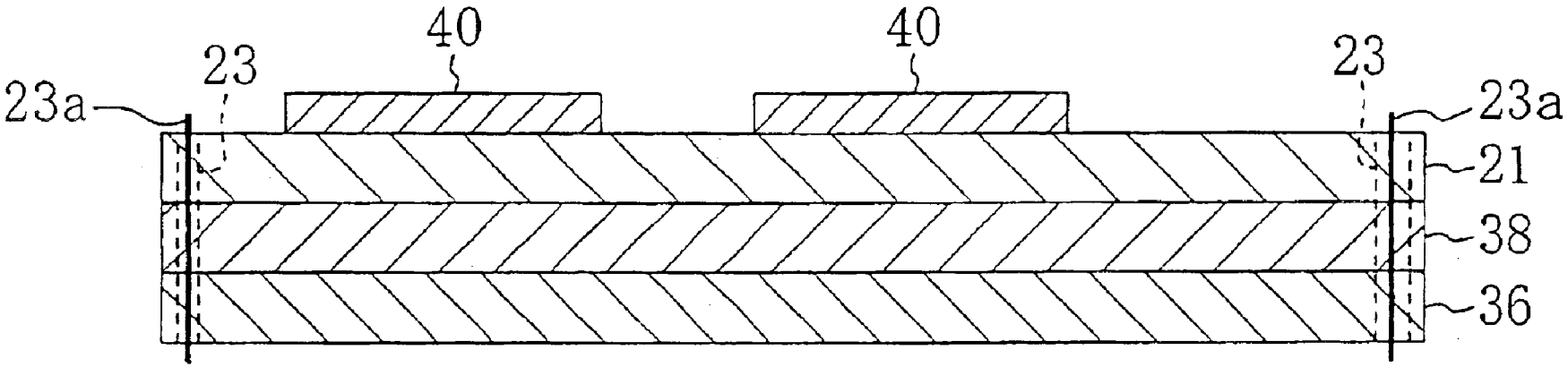
FIG. 4 is a cross-sectional view taken along line C—C of FIG. 2.

FIG. 4 is a cross-sectional view taken along line C—C of FIG. 2. Each of the line heads 1 to 4 includes one pressure chamber plate 21, a channel plate 38 and a nozzle plate 36 attached together. The pressure chamber plate 21, the channel plate 38 and the nozzle plate 36 are precisely aligned with one another by alignment means 23. In the present embodiment, the alignment means 23 includes a through hole through which a positioning pin 23*a* is passed. Thus, the nozzle plate 36, the channel plate 38 and the pressure chamber plate 21 are precisely aligned with one another, by laying them on one another so that the positioning pin 23*a* passes through the through hole in the plates. Note that the alignment means 23 is not limited to physical means, but may be other means. For example, an alignment marker may be provided on each plate, and the plates may be aligned with one another using optical means.

Figure 5:
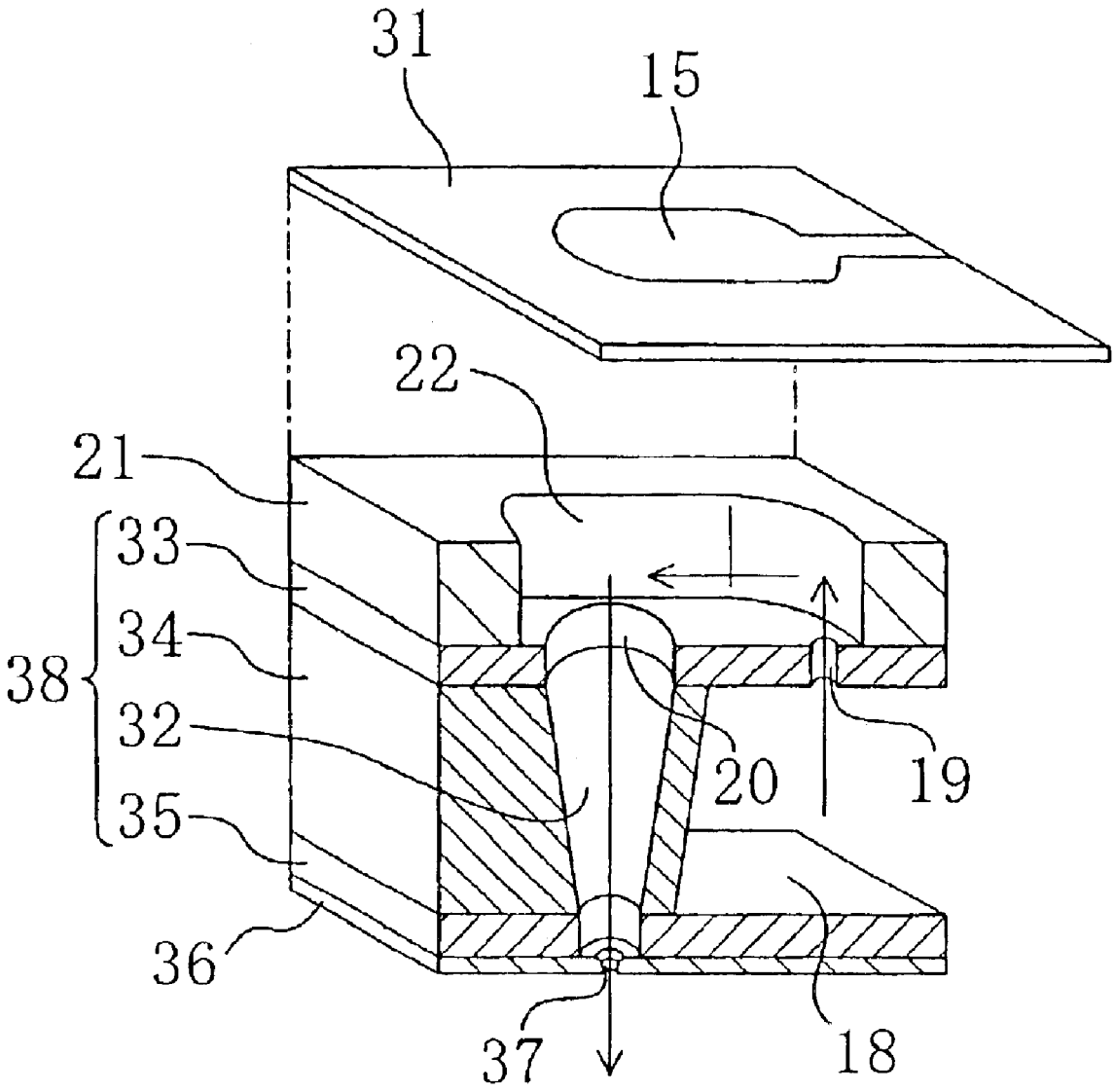
FIG. 5 is a perspective view illustrating an important part of an ink jet head including a cross section along line A—A of FIG. 2.

FIG. 5 shows a perspective view illustrating an important part including a cross section along line A—A of FIG. 2. A plurality of pressure chambers 22 are formed in the pressure chamber plate 21. The channel plate 38 includes a first plate 33 in which an ink channel inlet 20 and an ink supply port 19 are provided, a second plate 34 in which an ink channel 32 and a common liquid chamber 18 are formed, and a third plate 35 in which an aperture for introducing the ink from the ink channel 32 to a nozzle 37 is formed. The channel plate 38 is formed by a metal material made of SUS, a photosensitive glass, a resin, etc. The nozzle plate 36 is made of a metal material such as SUS, or a resin material such as PI (polyimide) having a thickness of 20 $\mu$m to 150 $\mu$m, and has the nozzle 37. The pressure chamber plate 21, the channel plate 38 and the nozzle plate 36 together form a pressure chamber block. The ink flows through the head as follows: the common liquid chamber 18→the ink supply port 19→the pressure chamber 22→the ink channel inlet 20→the ink channel 32→the nozzle 37, so as to be discharged through the nozzle 37, after which it strikes the recording medium 9.

Figure 6:
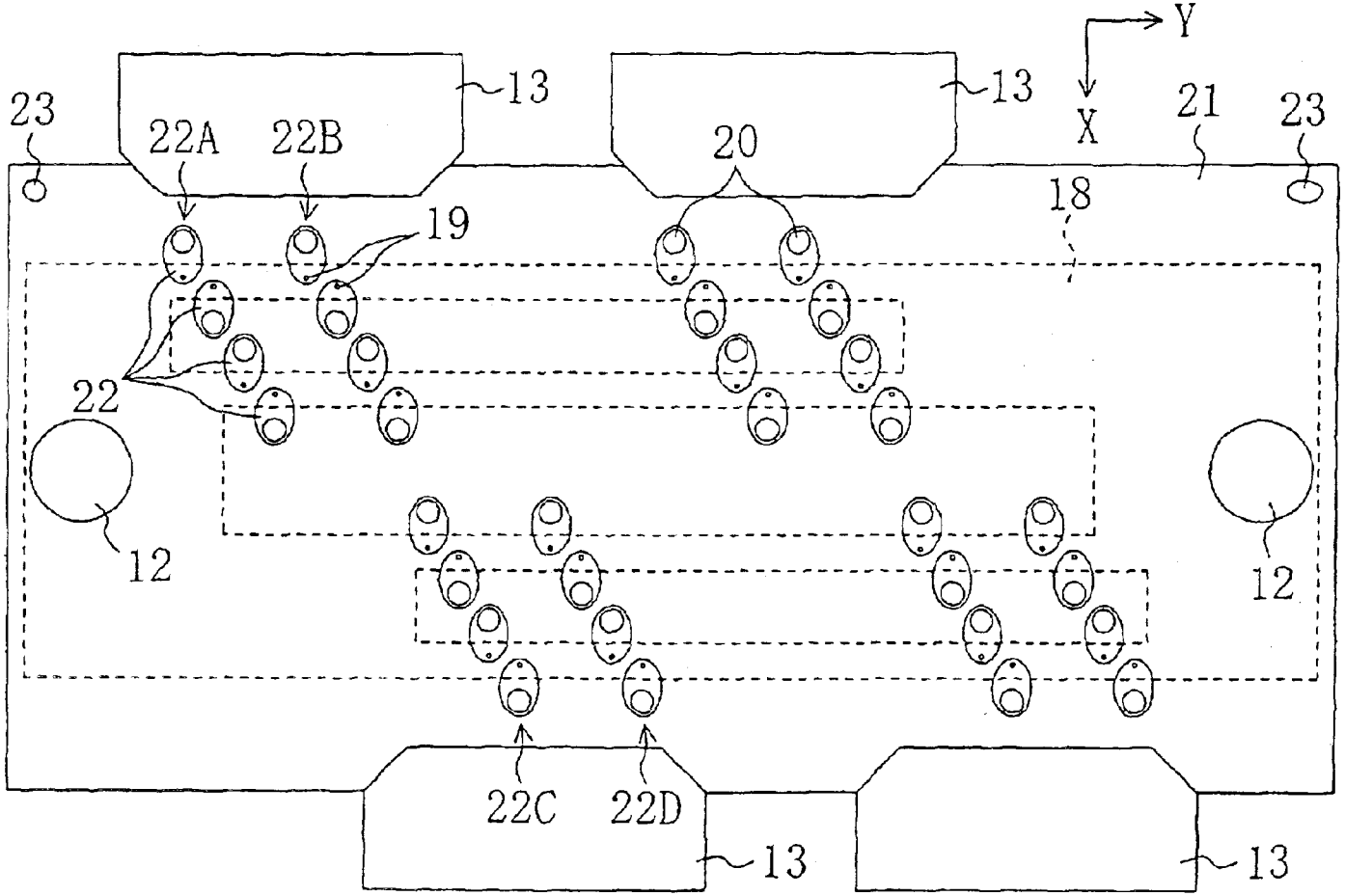
FIG. 6 is a plan view illustrating a pressure chamber plate.

FIG. 6 is a plan view illustrating the pressure chamber plate 21. As illustrated in FIG. 6, the pressure chambers 22 are arrayed at intervals of 600 dpi (42.3 $\mu$m) in the head width direction Y. It should be noted that the pressure chambers 22 are not arrayed in a single line in the head width direction Y, but are appropriately shifted from one another in the recording medium carrying direction X in order to increase the head density. Specifically, pressure chamber columns 22A, 22B, 22C and 22D are formed in the pressure chamber plate 21. Each pressure chamber column includes four pressure chambers 22 arranged so as to be inclined with respect to the head width direction Y. In other words, each of the pressure chamber columns 22A, 22B, 22C and 22D includes four pressure chambers 22 arranged in an upper left to lower right direction in FIG. 6. The pressure chamber columns 22A are adjacent to the pressure chamber columns 22B, and the pressure chamber columns 22C are adjacent to the pressure chamber columns 22D, respectively, in the head width direction Y. On the other hand, the pressure chamber columns 22B and 22C are shifted from each other in the recording medium carrying direction X. Next to the four pressure chamber columns 22A, 22B, 22C and 22D in the head width direction Y, another set of pressure chamber columns 22A, 22B, 22C and 22D are arranged in a similar pattern. Note that although only two sets of pressure chamber columns 22A, 22B, 22C and 22D are shown in FIG. 6 for ease of understanding, a large number of pressure chamber columns are actually formed.

The ink supply port 19 and the ink channel inlet 20 are provided on the bottom surface of each pressure chamber 22. The ink supply port 19 communicates the common liquid chamber 18 and the pressure chamber 22 to each other. The inside of the common liquid chamber 18 is filled with an ink. The ink tube port 12 is provided on both sides of the common liquid chamber 18. The common liquid chamber 18 has a structure such that the ink is supplied through the ink tube port 12.

FIG. 7A to FIG. 7I are process diagrams illustrating a method of manufacturing the line heads 1 to 4, each showing a cross section taken along line B—B of FIG. 2. Next, the steps of manufacturing a line head will be described with reference to FIG. 7A to FIG. 7I.

First, a substrate 60 having a size of 20 mm×25 mm and made of MgO, Si, SUS, etc., is provided. Herein, an MgO substrate is used.

Figure 7F:
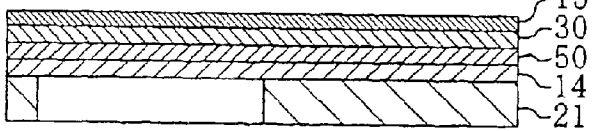
FIG. 7A to FIG. 7I are process diagrams illustrating a method of manufacturing a line head.
Figure 7G:
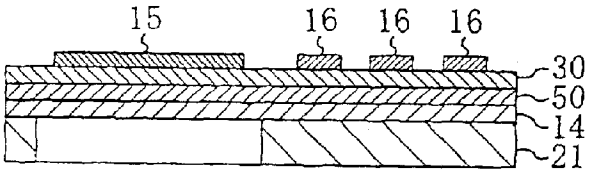
Figure 7H:
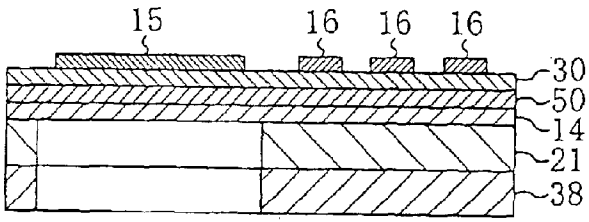
Figure 7I:
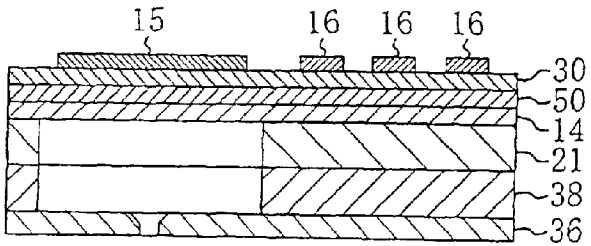
Figure 7A:
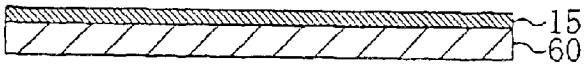

Then, as illustrated in FIG. 7A, the first electrode 15 made of platinum is formed on the substrate 60 by RF sputtering (radio frequency sputtering).

Figure 7B:
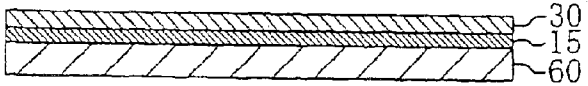

Then, as illustrated in FIG. 7B, the piezoelectric element 30 made of a PZT thin film is formed on the first electrode 15 by RF sputtering. Particularly, when a single crystal substrate of MgO is used as the substrate 60, and the first electrode 15 made of platinum is formed on the (100) plane of the MgO substrate 60, with the piezoelectric element 30 being formed thereon, it is possible to produce a piezoelectric element 30 with a stable and high piezoelectric property.

Figure 7C:
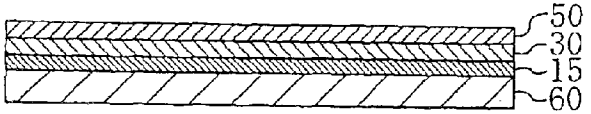

Then, as illustrated in FIG. 7C, the second electrode 50 made of platinum is formed on the piezoelectric element 30 by RF sputtering.

Figure 7D:
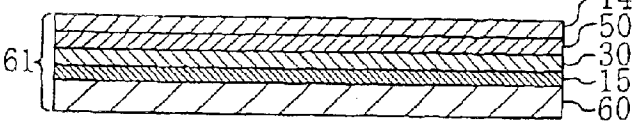

Then, as illustrated in FIG. 7D, the vibration plate 14 made of chrome is formed on the second electrode 50 by RF sputtering. At this stage, a substrate block 61 is completed. Note that the substrate block 61 is a member used for transferring the actuator block 40 from the substrate 60 onto the pressure chamber plate 21. The substrate block 61 includes the substrate 60 and the actuator block 40.

Figure 7E:
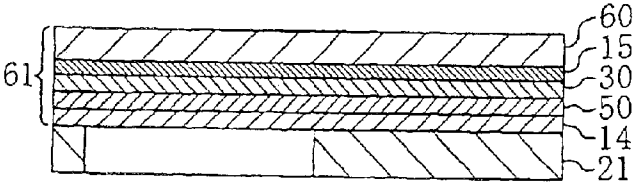

Then, a uniform electrodeposition resin layer (not shown) is formed on the pressure chamber plate 21 by using an electrodeposition process. Then, as illustrated in FIG. 7E, a plurality of substrate blocks 61 are attached to the pressure chamber plate 21 so that the vibration plate 14 and the pressure chamber plate 21 contact each other via the electrodeposition resin layer being sandwiched therebetween.

Figure 8:
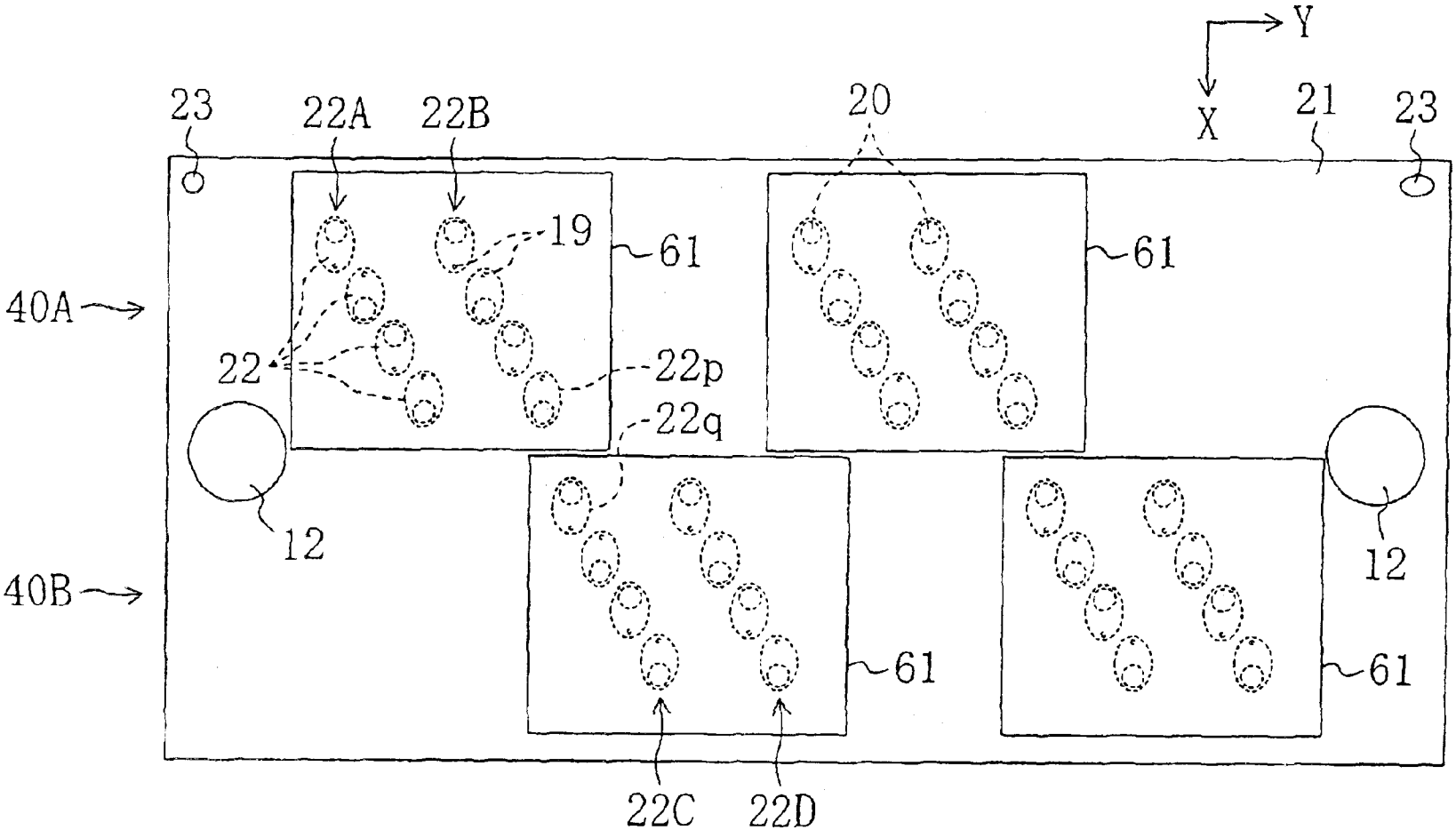
FIG. 8 is a diagram illustrating a plurality of substrate blocks being attached to a pressure chamber plate.

FIG. 8 is a schematic structure diagram illustrating the substrate blocks 61 being attached to the pressure chamber plate 21. As illustrated in FIG. 8, in the attachment of the substrate blocks 61, it is ensured that the substrate blocks 61 do not contact one another so as to uniformly and reliably attach the vibration plate 14 to the pressure chamber plate 21. Specifically, the substrate blocks 61 are spaced apart from one another so as to provide a gap between adjacent substrate blocks 61 with respect to the head width direction Y. Moreover, adjacent substrate blocks 61 are slightly spaced apart from each other also with respect to the recording medium carrying direction X.

In a line head of the present embodiment, the nozzles 37, 37, . . . , are arrayed at a small pitch in the head width direction Y. Therefore, when one attempts to array the substrate blocks 61 in a single line with no gap therebetween, even a slight error in the size or shape among the substrate blocks 61 or a slight error in the arrangement may result in the substrate blocks 61 overlapping one another. If such a contact between the substrate blocks 61 occurs, the actuators on the pressure chambers overlap on one another, whereby the actuators do not deform properly. When the substrate blocks 61 are spaced apart from one another, the actuators do not reliably cover the pressure chambers, whereby the actuators do not deform properly, thus deteriorating the yield. In a head having densely arranged nozzles produced by arraying the substrate blocks 61 in a single line with no gap therebetween, the alignment precision between the pressure chambers and the actuator blocks is very high, and it is difficult to produce such a head. In view of this, the present embodiment addresses the problem of densely arranged nozzles by arranging the substrate blocks 61 in a pattern such that the first column of substrate blocks 61 and the second column of substrate blocks 61 partially overlap with each other with respect to the head width direction Y. Moreover, as illustrated in FIG. 8, a rightmost pressure chamber 22*p* in the first column of substrate blocks 61 overlaps with a leftmost pressure chamber 22*q* in the second column of substrate blocks 61 with respect to the head width direction Y so that each one of the pressure chambers 22 partially overlaps with another pressure chamber 22 with respect to the head width direction Y. Therefore, there can be seen an overlap portion with respect to the head width direction Y between the actuator block 40 in the first column and the actuator block 40 in the second column. In this way, the pressure chambers 22 can be arranged with a high density so as to correspond to the nozzles 37 arranged with a high density in the head width direction Y. Moreover, it is possible to eliminate the shift in the interval between the pressure chambers 22 that are positioned at the edges of the substrate blocks 61. Therefore, with the present line head, it is possible to obtain a high-quality image with no streaks. Moreover, since the substrate blocks 61 are arranged in a staggered pattern, the length of the head in the carry direction X can be reduced as compared to the case where the substrate blocks are arranged on a straight line extending in an upper left to lower right direction in FIG. 8.

After the attachment of the substrate blocks 61 as described above, the substrate 60 is etched away by using an acidic solution, as illustrated in FIG. 7F.

Then, a mask (not shown) produced by an aligner with a high precision is positioned on the first electrode 15 by using the alignment means 23 provided in the pressure chamber plate 21. Then, as illustrated in FIG. 7G, the first electrode 15 is patterned so as to form the first electrodes 15 and the lead sections 16 in a predetermined shape. Thus, the first electrodes, 15 and the lead sections 16 can be formed with a high precision by aligning the single pressure chamber plate 21, which is provided commonly to the plurality of substrate blocks 61, with a mask produced by an aligner with a high precision.

Then, as illustrated in FIG. 7H, the pressure chamber plate 21 and the channel plate 38 are positioned with respect to each other by using the alignment means 23 provided in the pressure chamber plate 21, and then attached to each other.

Then, as illustrated in FIG. 7I, the channel plate 38 and the nozzle plate 36 are positioned with respect to each other by using the alignment means 23 provided in the pressure chamber plate 21 or the channel plate 38, and then attached to each other. In this way, a line head, in which the various plates are precisely aligned with one another, is completed.

In the present embodiment, the attachment process is performed in the following order: the pressure chamber plate 21→the channel plate 38→the nozzle plate 36. Alternatively, the pressure chamber plate 21 and the channel plate 38 may be attached to each other after attaching the channel plate 38 and the nozzle plate 36 to each other.

Figure 3B:
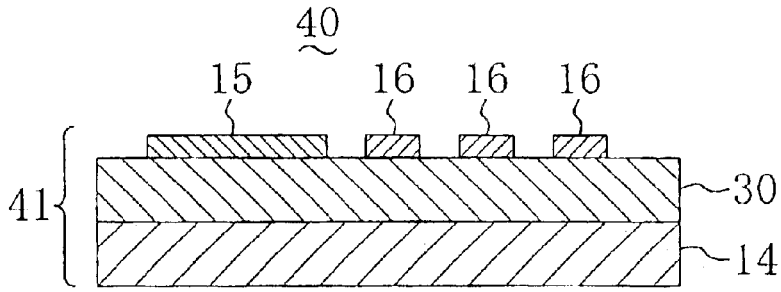

Moreover, in the embodiment described above, the vibration plate 14 and the second electrode 50 are formed separately, as illustrated in FIG. 3A. However, in a case where the vibration plate 14 is made of a conductive material such as chrome, the vibration plate 14 may function also as the second electrode 50. Therefore, the vibration plate 14 functioning also as the second electrode may be provided, as illustrated in FIG. 3B, without separately providing the vibration plate 14 and the second electrode 50.

Moreover, a conductive material such as Cu or Ti may be provided as an intermediate layer between the piezoelectric element 30 and the vibration plate 14 for the purpose of improving the voltage endurance and increasing the attachment strength.

Figure 3C:
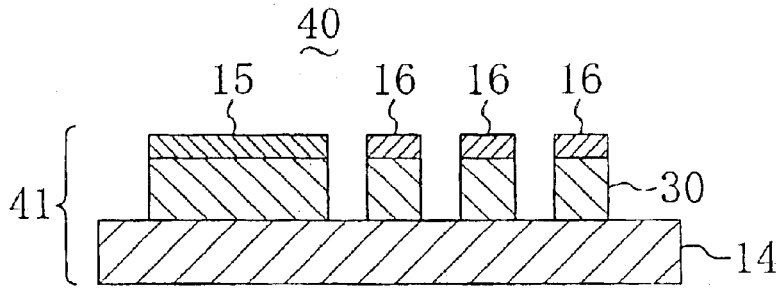

Moreover, the piezoelectric element 30 may be patterned and divided along with the first electrode 15, as illustrated in FIG. 3C. In this way, the vibration plate 14 is more flexible so that it can be deformed to a greater degree with the same voltage being applied.

Figure 9A:
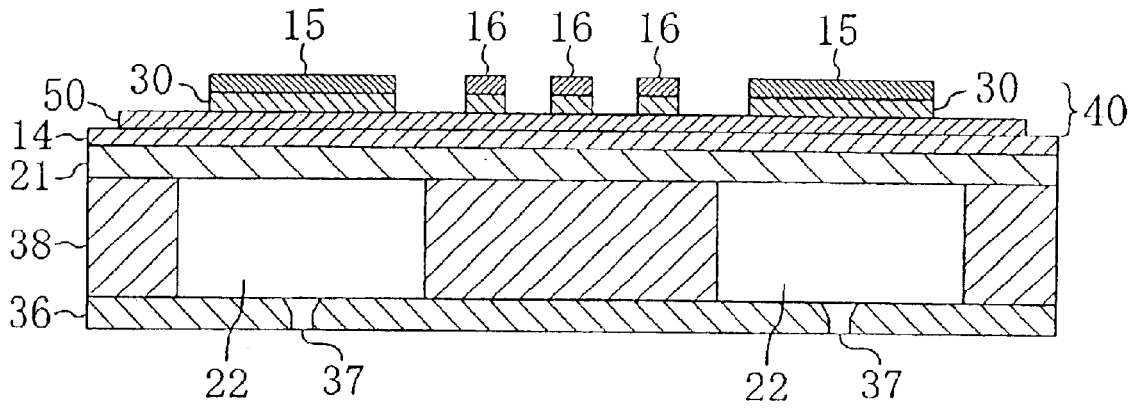
FIG. 9A and FIG. 9B are each a cross-sectional view illustrating a line head according to a variation of the pressure chamber block.
Figure 9B:
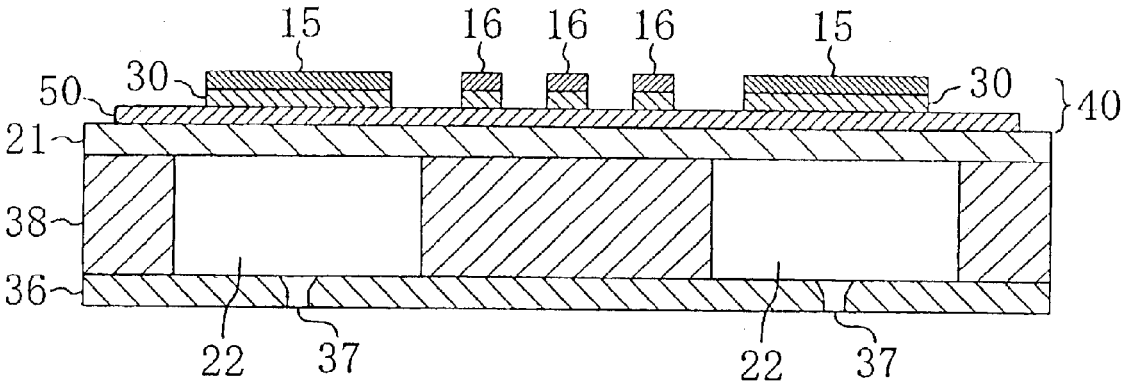

Moreover, while the actuator block 40 is formed by the vibration plate 14, the second electrode 50, the piezoelectric element 30 and the first electrode 15 in the embodiment described above, it may alternatively be formed by the second electrode 50, the piezoelectric element 30 and the first electrode 15, as illustrated in FIG. 9A and FIG. 9B.

Figure 3D:
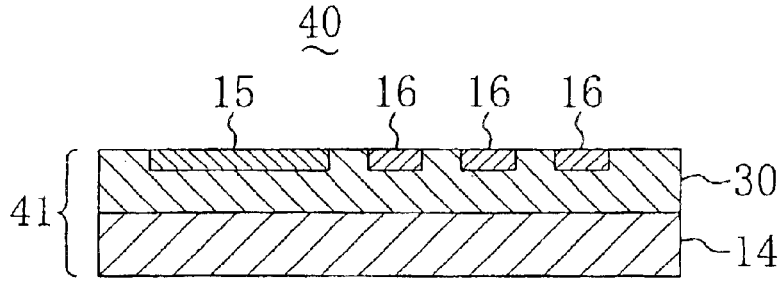

By patterning the first electrode 15 immediately after the formation of the first electrode 15 on the substrate 60 as illustrated in FIG. 7A, the piezoelectric element 30 can be provided around the first electrodes 15 and the lead sections 16, as illustrated in FIG. 3D. In this way, the voltage endurance of the first electrodes 15, the lead sections 16 and the vibration plate 14 can be improved.

Moreover, while the first electrode and the second electrode are the separate electrode and the common electrode, respectively, in the present embodiment, they may be reversed. That is, the first electrode and the second electrode may alternatively be the common electrode and the separate electrode, respectively.

Figure 10:
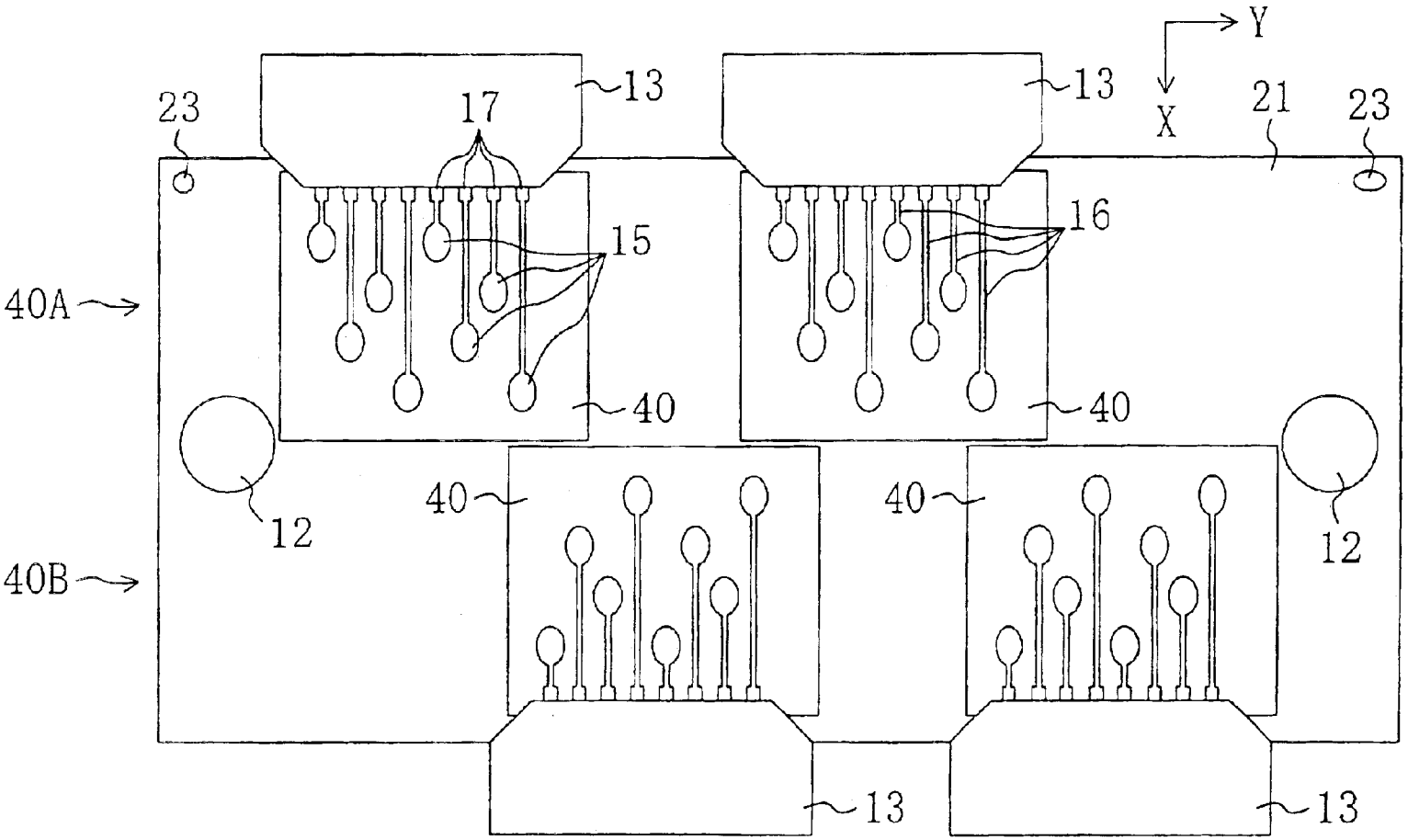
FIG. 10 is a plan view illustrating a pressure chamber plate according to a variation in which the arrangement of first electrodes is changed.

Moreover, in the embodiment described above, the first electrodes 15 in one actuator block 40 are arranged along an inclined line with respect to the carry direction X, as illustrated in FIG. 2. Alternatively, the first electrodes 15 may be arranged alternately in the head width direction Y, as illustrated in FIG. 10. In other words, the first electrodes 15 may be arranged in a zigzag pattern. In this way, the distance between adjacent pressure chambers 22 and 22 increases, whereby crosstalk is less likely to occur. Thus, it is possible to further reduce the interval between the pressure chambers 22 with respect to the head width direction Y and thus to arrange the pressure chambers 22 with an even higher density.

Embodiment 2

Figure 11A:
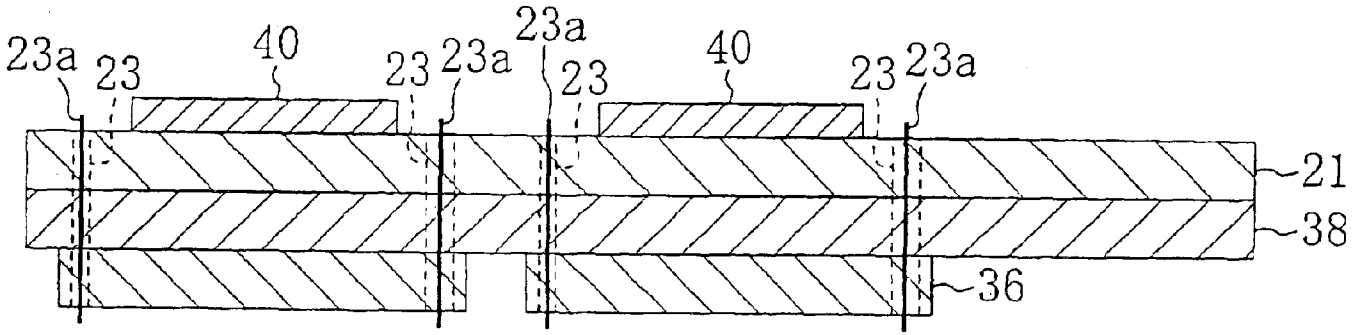
FIG. 11A and FIG. 11B are each a cross-sectional view illustrating a line head according to Embodiment 2, taken along line C—C of FIG. 2.
Figure 11B:
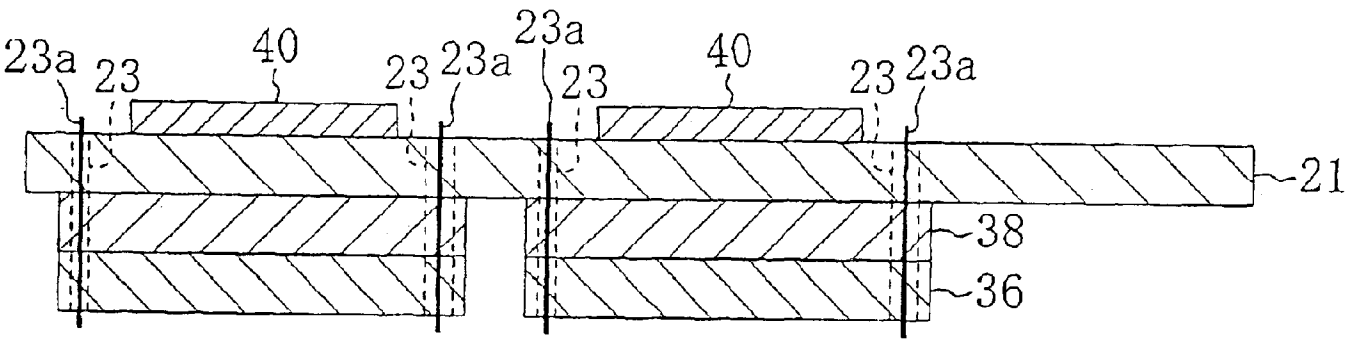

While the channel plate 38 and the nozzle plate 36 are each produced from a single plate member in Embodiment 1, the channel plate 38 or the nozzle plate 36 is produced from a plurality of plate members in the present embodiment, as illustrated in FIG. 11A or FIG. 11B.

A line head having a plurality of nozzle plates 36 will be described with reference to FIG. 11A. The production method is as that of Embodiment 1 up to the attachment of the actuator blocks 40, the pressure chamber plate 21 and the channel plate 38 to one another. The present embodiment differs from Embodiment 1 in that a plurality of nozzle plates 36 each having a smaller area than that of the pressure chamber plate 21 are attached to the channel plate 38. In the attachment process, first, the nozzle plates 36 are positioned by using the alignment means 23 provided in the pressure chamber plate 21 or the channel plate 38, and then the nozzle plates 36 are attached to the channel plate 38.

Figure 12:
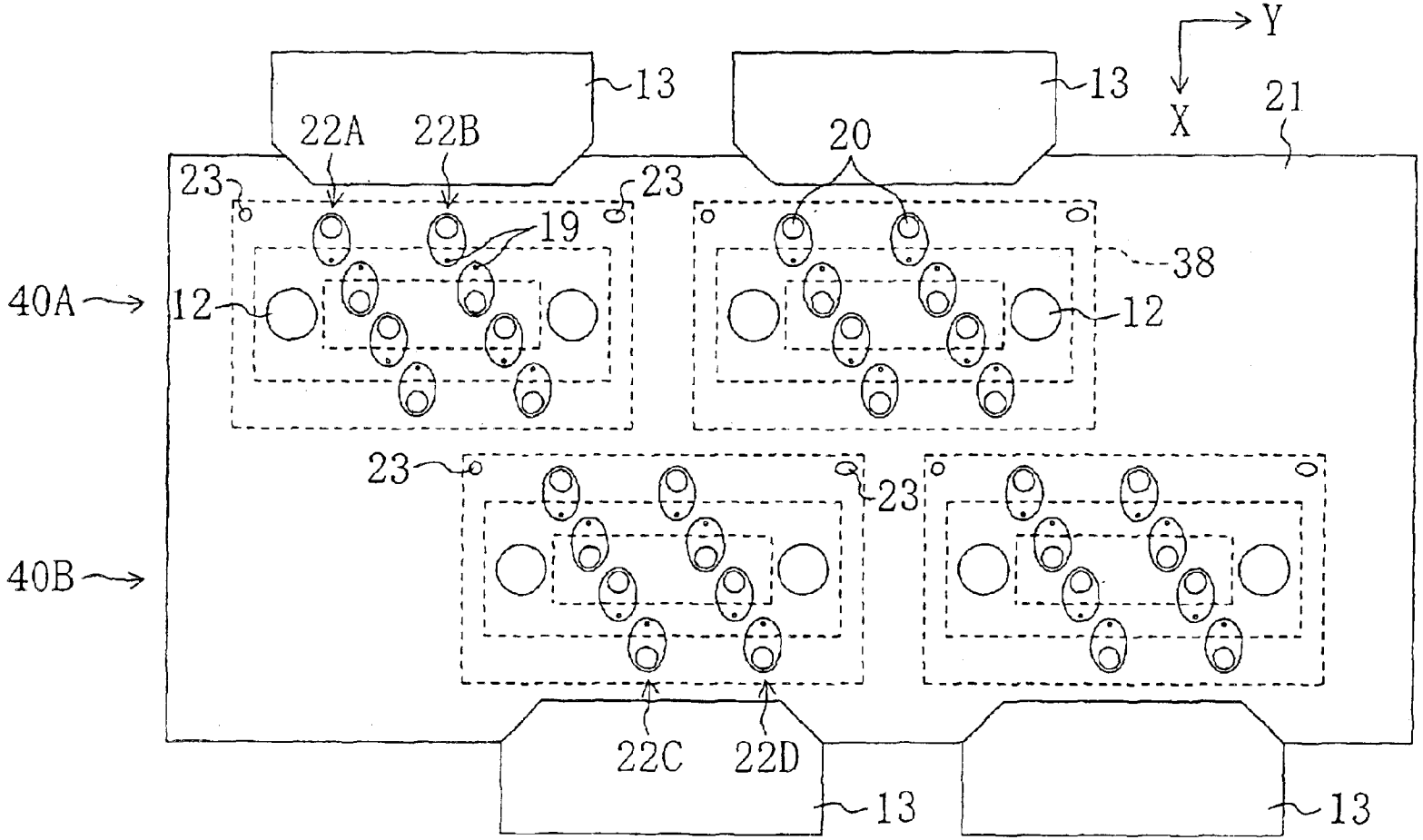
FIG. 12 is a plan view illustrating a pressure chamber plate according to Embodiment 2.
Figure 13:
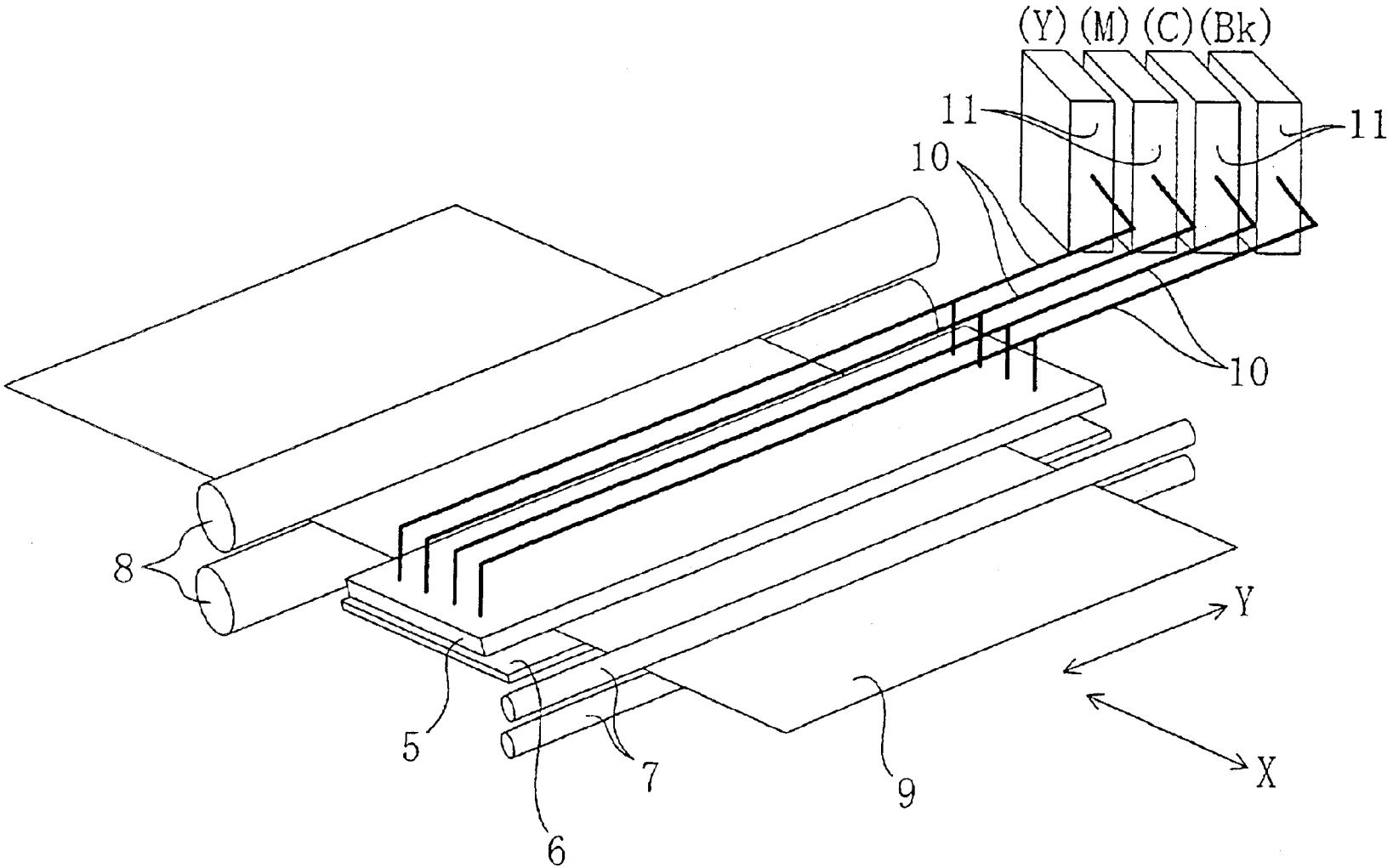
FIG. 13 is a schematic perspective view illustrating a line head according to Embodiment 3.

Next, a line head having a plurality of channel plates 38 and a plurality of nozzle plates 36 will be described with reference to FIG. 11B. The production method is as that of Embodiment 1 up to the attachment of the actuator blocks 40 and pressure chamber plate 21 to each other. The present embodiment differs from Embodiment 1 in the subsequent steps including the attachment of the channel plates 38. In this embodiment, the channel plates 38 each having a smaller area than that of the pressure chamber plate 21 and the nozzle plates 36 each having a smaller area than that of the pressure chamber plate 21 are prepared. FIG. 12 is a plan view illustrating the pressure chamber plate 21 of the present embodiment. In the present embodiment, first, the channel plates 38 are positioned by using a plurality of alignment means 23 provided in the pressure chamber plate 21, and then the pressure chamber plate 21 and the channel plates 38 are attached to each other. Then, the nozzle plates 36 are positioned by using the alignment means 23 provided in the pressure chamber plate 21 or the channel plates 38, and the channel plates 38 and the nozzle plates 36 are attached to each other.

In this way, the components are used only where they are needed, thereby reducing the cost. Specifically, the nozzle plate 36 and the channel plate 38 are used only where they are needed, thereby reducing the cost. Moreover, the nozzle plate 36 or the channel plate 38 is provided in the form of a plurality of plates, whereby even if a defect is included in one or some of the plates, such plates can be removed during the inspection process, so that the other normal plates can be used as they are. In other words, when the nozzle plate 36 and the channel plate 38 are each formed in the form of a single plate, and if a defect is included in one of the plates, the plate as a whole becomes unusable as being defective. However, by using a plurality of plates as described above, a defect in one or some of the plates does not make all the plates unusable. Therefore, the yield can be improved.

Embodiment 3

In the line heads 5 of Embodiments 1 and 2, the line heads (the first to fourth line heads 1 to 4) independently provided for different colors are attached to the recording apparatus after they are aligned in the head width direction Y so as to align the striking positions of the respective inks of different colors with one another. In contrast, in the present embodiment, the line heads of different colors are integrated into a single line head 5. The pressure chambers 22 for the inks of different colors are provided in the pressure chamber plate 21, and the inks of different colors are supplied to the single line head 5 through the ink tubes 10.

Figure 14:
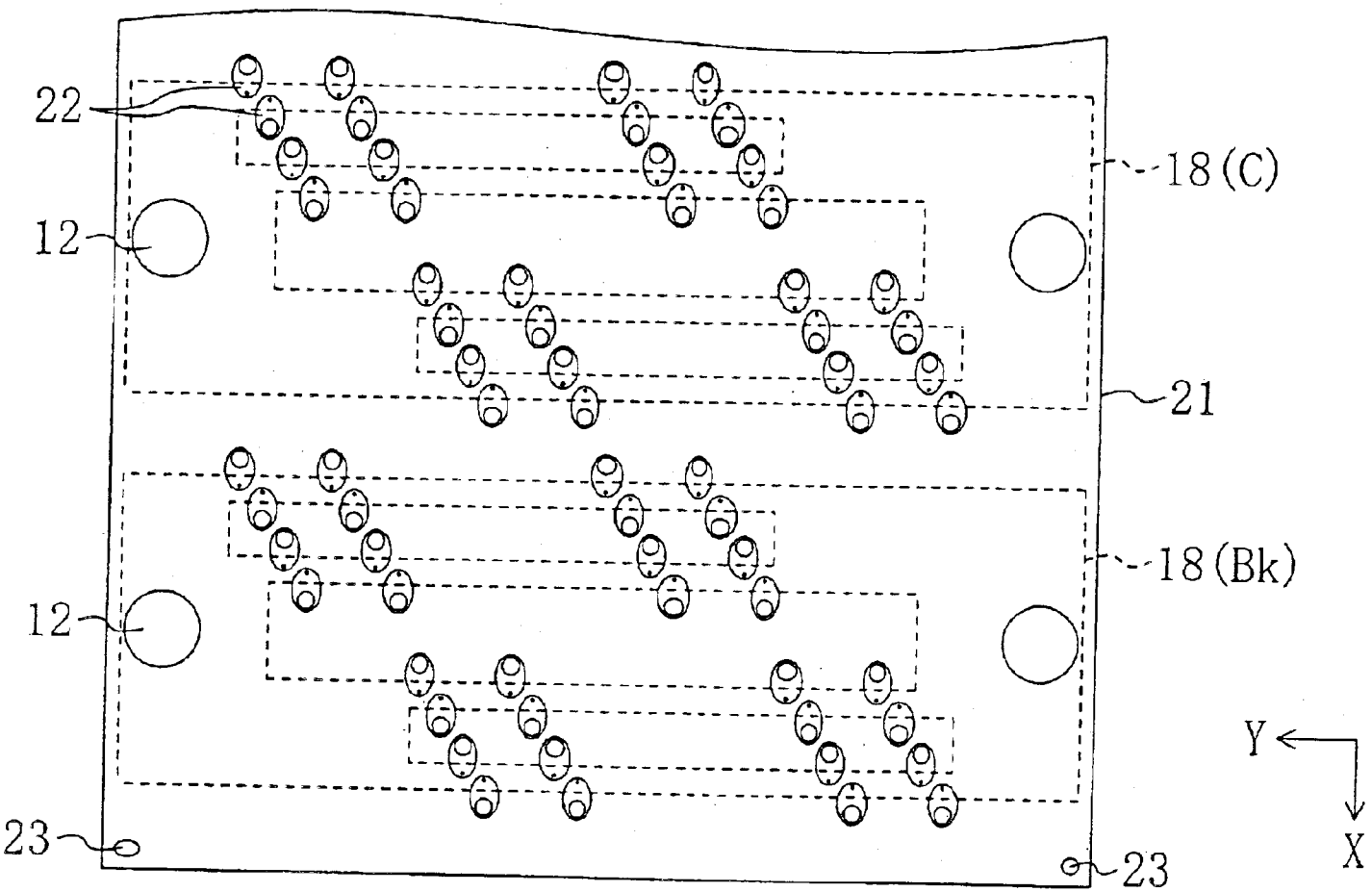
FIG. 14 is a plan view illustrating a pressure chamber plate according to Embodiment 3.

FIG. 14 is a plan view illustrating a part of the pressure chamber plate 21 of the present embodiment. The pressure chambers 22, the common liquid chambers 18, etc., for the respective inks of black (Bk), cyan (C), magenta (M) and yellow (Y) are arranged in the pressure chamber plate 21 in this order in the direction opposite to the carry direction X. The pitch of the pressure chambers 22 of the respective colors is 600 dpi, and the arrangement pattern of the pressure chambers 22 of the respective colors is as that of Embodiment 1. On the other hand, the pressure chamber of the black ink, the pressure chamber of the cyan ink, the pressure chamber of the magenta ink, and the pressure chamber of the yellow ink, are arranged so as to be aligned with one another with respect to the head width direction Y. In other words, the pressure chambers of the respective colors are arranged on a straight line in the carry direction x. Moreover, the pressure chambers 22 of different colors are communicated to the common liquid chambers 18 of the respective colors, and the inks are supplied to the common liquid chambers 18 through the respective ink tube ports 12.

In this way, the pressure chambers 22 of the respective colors can be precisely arrayed in the single pressure chamber plate 21 in the carry direction X. Therefore, the ink droplets of the respective colors can be made to precisely strike the recording medium. Thus, it is possible to form a high-quality image.

Embodiment 4

Figure 15:
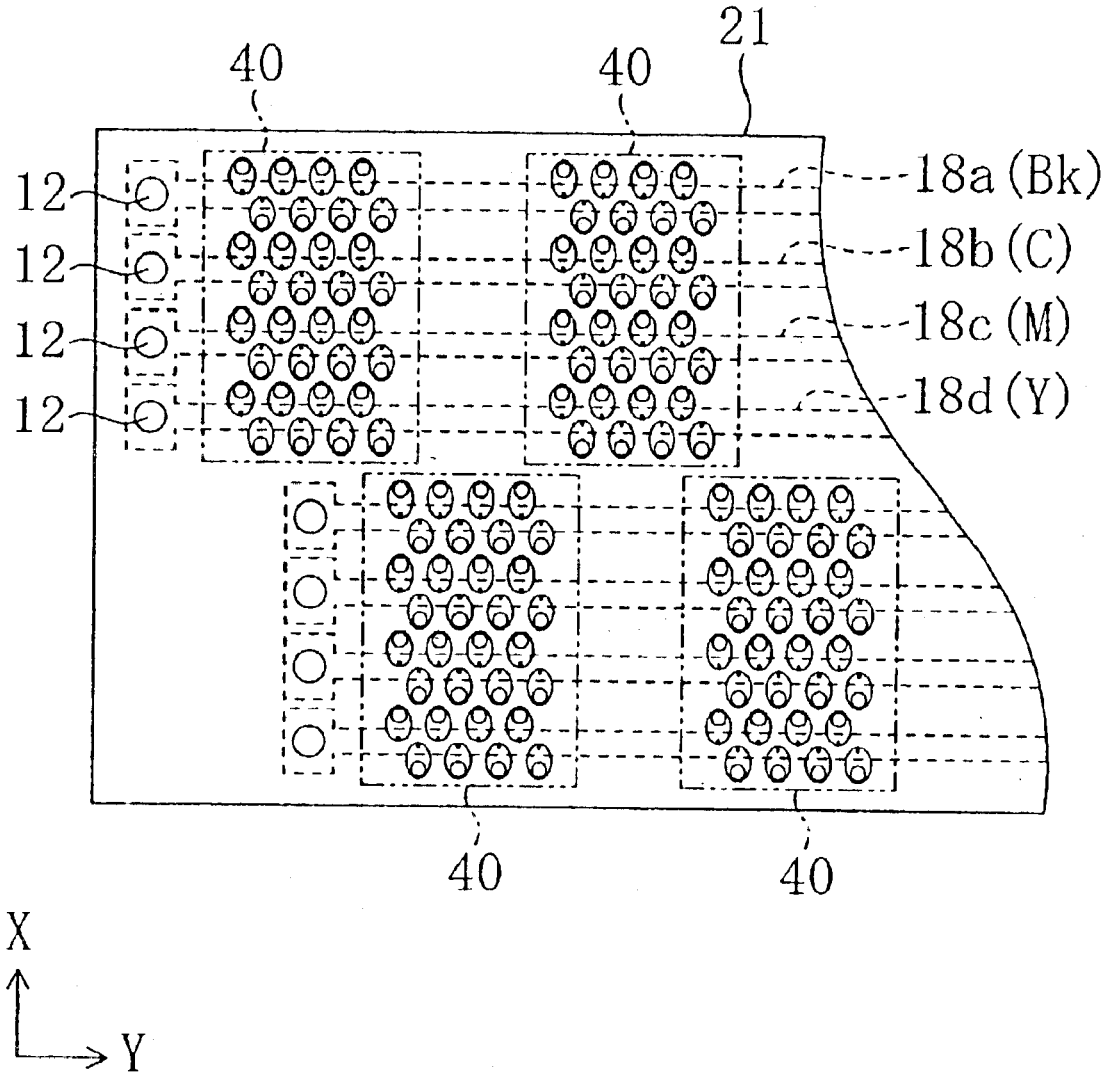
FIG. 15 is a plan view illustrating a pressure chamber plate according to Embodiment 4.

In Embodiment 4, as in Embodiment 3, the line heads of different colors are integrated into a single line head, as illustrated in FIG. 15. The present embodiment differs from Embodiment 3 in that while each actuator block 40 covers the pressure chamber 22 of the ink of one color in Embodiment 3, each actuator block 40 covers the pressure chambers 22 of the inks of a plurality of colors in Embodiment 4. As in Embodiments 1 to 3, the actuator blocks 40 are arranged in a staggered pattern.

The pressure chambers 22 of the inks of different colors are arrayed in the head width direction Y at a pitch of 600 dpi. The pressure chambers of the black ink, the cyan ink, the magenta ink and the yellow ink are arranged so as to be aligned with one another with respect to the head width direction Y. A common liquid chamber 18*a* of the black ink, a common liquid chamber 18*b* of the cyan ink, a common liquid chamber 18*c* of the magenta ink, and a common liquid chamber 18*d* of the yellow ink, are arrayed in the carry direction X. Each of the common liquid chambers 18*a* to 18*d* extends in the head width direction Y, and is provided with the ink tube port 12 at both ends thereof. Since two columns of actuator blocks 40 are provided with respect to the carry direction X, two sets of the common liquid chambers 18*a* to 18*d* are provided so as to correspond to the actuator blocks 40.

In Embodiment 4, the pressure chambers 22 for four colors are covered by a single actuator block 40, whereby the pressure chambers 22 can be arranged at a higher density. Moreover, it is possible to increase the number of actuators included in the actuator block 40. Therefore, it is possible to downsize the head, reduce the number of manufacturing steps, and reduce the cost.

Other Embodiments

Note that the types of ink are not limited to the four colors of black, cyan, magenta and yellow. Alternatively, two or three, or five or more, inks may be used. Alternatively, only one of the line heads 1 to 4 of Embodiment 1 may be used while using an ink of a single color. A plurality of types of ink of the same color may be used.

The ink jet head of the present invention is not limited to a line type ink jet head.

The present invention is not limited to the embodiments set forth above, but may be carried out in various other ways without departing from the sprit or main features thereof.

Thus, the embodiments set forth above are merely illustrative in every respect, and should not be taken as limiting. The scope of the present invention is defined by the appended claims, and in no way is limited to the description set forth herein. Moreover, any, variations and/or modifications that are equivalent in scope to the claims fall within the scope of the present invention.

What is claimed is:

1. An ink jet head for a color printer, comprising:

a pressure chamber block having therein a plurality of pressure chambers each containing an ink; and a plurality of actuator blocks, each of the actuator blocks having a plurality of actuator, each of the actuators having a piezoelectric element, and a first electrode and a second electrode for applying a voltage across the piezoelectric element, each of the actuators covering one of the pressure chambers, wherein;

the actuator blocks and the pressure chamber block are layered on each other;

the pressure chamber block is a single block and not an integrated block with respect to a scanning direction;

an area of a layering surface of each of the actuator blocks is smaller than an area of a layering surface of the pressure chamber block; and the plurality of actuator blocks are arranged on one surface of the pressure chamber block.

2. The ink jet head of claim 1, wherein the pressure chamber block includes: a pressure chamber plate having therein the plurality of pressure chambers each containing an ink; a channel plate having therein a plurality of ink channels respectively communicated to the pressure chambers and a common liquid chamber communicated to the pressure chambers; and a nozzle plate having therein a plurality of nozzles respectively communicated to the ink channels, the pressure chamber plate, the channel plate and the nozzle plate being layered on one another.

3. The ink jet head of claim 2, wherein the ink jet head is obtained by producing an actuator block by sequentially layering at least the first electrode, the piezoelectric element, and the second electrode, on a substrate having a smaller area than that of the pressure chamber plate, and then transferring the actuator block onto the pressure chamber plate so that the plurality of pressure chambers provided in the pressure chamber plate are covered by the second electrode.

4. The ink jet head of claim 3, wherein the substrate is an MgO single crystal substrate, and the piezoelectric element is produced by sputtering.

5. The ink jet head of claim 3, wherein the substrate is an MgO single crystal substrate.

6. The ink jet head of claim 3, wherein the piezoelectric element is produced by sputtering.

7. The ink jet head or claim 2, wherein the ink jet head is obtained by producing an actuator block by sequentially layering at least the first electrode, the piezoelectric element, the second electrode, and a vibration plate, on a substrate having a smaller area than that of the pressure chamber plate, and then transferring the actuator block onto the pressure chamber plate so that the plurality of pressure chambers provided in the pressure chamber plate are covered by the vibration plate.

8. The ink jet head of claim 7, wherein the substrate is an MgO single crystal substrate, and the piezoelectric element in produced by sputtering.

9. The ink jet head of claim 7, wherein the substrate is an MgO single crystal substrate.

10. The ink jet head of claim 7, wherein the piezoelectric element is produced by sputtering.

11. The ink jet head of claim 1, wherein the plurality at actuator blocks are arranged so that edge surfaces of ones of the actuator blocks adjacent to each other in a direction perpendicular to a scanning direction are not in contact with each other.

12. The ink jet head of claim 1, wherein the plurality of actuator blocks are arranged so as to be separated from one another so that adjacent ones of the actuator blocks partially overlap with each other with respect to a direction perpendicular to a scanning direction.

13. The ink jet head of claim 1, wherein the plurality of actuator blacks are arranged so that adjacent ones at the actuator of blocks are spaced apart from each other in a scanning direction.

14. The ink jet head of claim 1, wherein the plurality of actuator blocks are arranged in a staggered pattern.

15. The ink jet head of claim 1, wherein the actuator blocks include, instead of the second electrode, a conductive vibration plate functioning also as the second electrode.

16. An ink jet recording apparatus for recording information using a plurality of colors of ink, comprising:

a plurality of the ink jet heads of claim 1 independently provided for the respective colors of ink; and movement means for relatively moving the ink jet heads and a recording medium with respect to each other in a scanning direction.

17. An ink jet head, comprising:

a pressure chamber block having therein a plurality of pressure chambers respectively containing a plurality of types of ink; and a plurality of actuator blocks, each of the actuator blocks having a plurality of actuators, each of the actuators having a piezoelectric element, and a first electrode and a second electrode for applying a voltage across the piezoelectric element, each of the actuators covering one of the pressure chambers, wherein;

the actuator blocks and the pressure chamber block are layered on each other;

the pressure chamber block is a single block and not an integrated block with respect to a scanning direction;

an area of a layering surface of each of the actuator blocks is smaller than an area of a layering surface of the pressure chamber block; and the plurality of actuator blocks are arranged on one surface of pressure chamber block.

18. The ink jet head of claim 17, wherein the pressure chamber block includes: a pressure chamber plate having therein a plurality of pressure chambers respectively containing a plurality of types of ink; a channel plate having therein a plurality of ink channels respectively communicated to the pressure chambers for the respective types of ink and a plurality of common liquid chambers respectively containing the types of ink and respectively communicated to the pressure chambers for the respective types of ink; and a nozzle plate having therein a plurality of nozzles respectively communicated to the ink channels for the respective types of ink, the pressure chamber plate, the channel plate and the nozzle plate being layered on one another.

19. The ink jet head of claim 18, wherein the pressure chamber plate is made of a single plate.

20. The ink jet head of claim 17, wherein the plurality of types of ink include a black ink, a cyan ink, a magenta ink and a yellow ink.

21. The ink jet head of claim 17, wherein the plurality of actuator blocks are arranged so that edge surfaces of ones of the actuator blocks adjacent to each other in a direction perpendicular to a scanning direction are not in contact with each other.

22. The ink jet head of claim 17, wherein the plurality of actuator blocks are arranged so as to be separated from one another so that adjacent ones of the actuator blocks partially overlap with each other with respect to a direction perpendicular to a scanning direction.

23. The ink jet head or claim 17, wherein the plurality of actuator blocks are arranged so that adjacent ones of the actuator blocks are spaced apart from each other in a scanning direction.

24. The ink jet head of claim 17, wherein the plurality of actuator blocks are arranged in a staggered pattern.

25. An ink jet recording apparatus, comprising:

the ink jet head of claim 17; and movement means for relatively moving the ink jet head and a recording medium with respect to each other in a scanning direction.

26. An ink jet head, comprising:

a pressure chamber block having therein a plurality of pressure chambers respectively containing a plurality of types of ink, wherein the pressure chambers for the respective types of ink are successively arranged in a scanning direction; and a plurality of actuator blocks, each of the actuator blocks having a plurality of actuators, each of the actuators having a piezoelectric element, and a first electrode and a second electrode for applying a voltage across the piezoelectric element, each of the actuators covering one of the pressure chambers, wherein;

the actuator blocks and the pressure chamber block are layered on each other;

the pressure chamber block is a single block and not an integrated block with respect to scanning direction;

an area of a layering surface of each of the actuator blocks is smaller than an area of a layering surface of the pressure chamber block; and the plurality of actuator blocks are arranged on one surface of the pressure chamber block so that each of the actuator blocks covers the pressure chambers for a plurality of types of ink.

27. The ink jet head of claim 26, wherein the pressure chamber block includes: a pressure chamber plate having therein a plurality of pressure chambers respectively containing a plurality of types of ink, wherein the pressure chambers for the respective types of ink are successively arranged in the scanning direction; a channel plate having therein a plurality of ink channels respectively communicate to the pressure chambers for the respective types of ink and a plurality of common liquid chambers respectively containing the types of ink and respectively communicated to the pressure chambers for the respective types of ink; and a nozzle plate having therein a plurality of nozzles respectively communicated to the ink channels for the respective types of ink, the pressure chamber plate, the channel plate and the nozzle plate being layered on one another.

28. The ink jet head of claim 26, wherein the plurality of types of ink include a black ink, a cyan ink, a magenta ink and a yellow ink.

29. The ink jet head of claim 26, wherein the plurality of actuator blocks are arranged so that edge surfaces of ones of the actuator blocks adjacent to each other in a direction perpendicular to a scanning direction are not in contact with each other.

30. The ink jet head of claim 26, wherein the plurality of actuator blocks are arranged so as to be separated from one another so that adjacent ones of the actuator block partially overlap with each other with respect to a direction perpendicular to the scanning direction.

31. The ink jet head of claim 26, wherein the plurality of actuator blocks are arranged so that adjacent ones of the actuator blocks are spaced apart from each other in a scanning direction.

32. The ink jet head of claim 26, wherein the plurality of actuator blocks are arranged in a staggered pattern.

33. An ink jet recording apparatus, comprising:

the ink jet head of claim 26; and movement means for relatively moving the ink jet head and a recording medium with respect to each other in a scanning direction.

34. An ink jet head, comprising:

a pressure chamber block having therein a plurality of pressure chambers each containing an ink, a plurality of nozzles, a plurality of ink channels for guiding the ink in the pressure chambers to the nozzles, respectively, and a common liquid chamber communicated to the plurality pressure chambers; and a plurality of actuator blocks, each of the actuator blocks having a plurality of actuators, each of the actuators having a piezoelectric element, and a first electrode and a second electrode for applying a voltage across the piezoelectric element, each of the actuators covering one of the pressure chambers, wherein:

the actuator blocks and the pressure chamber block are layered on each other;

the pressure chamber block is a single block and not an integrated block with respect to a scanning direction;

an area of a layering surface of each of the actuator blocks is smaller than an area of a layering surface of the pressure chamber block; and the plurality of actuator blocks are arranged on one surface of the pressure chamber block.

35. A method of manufacturing an ink jet head, comprising:

a block production step of producing plurality of actuator blocks by sequentially layering at least a first electrode, a piezoelectric element, and a second electrode, or by sequentially layering at least a first electrode, a piezoelectric element, a second electrode, and a vibration plate, on each of a plurality of substrates each having a smaller area than that of a pressure chamber plate, which is a single plate and not an integrated plate with respect to a scanning direction;

a first attachment step of attaching the actuator blocks layered on the respective substrates to one surface of the pressure chamber plate so that some of a plurality of pressure chambers provided in the pressure chamber plate are covered by the second electrode or the vibration plate of each of the actuator blocks;

a step of removing the substrates; and a step of patterning the first electrode of each of the actuator blocks.

36. The method of manufacturing an ink jet head of claim 35, comprising, after the step of patterning the first electrode:

a step of attaching a channel plate on the other surface of the pressure chamber plate, the channel plate having therein ink channels for guiding the ink in the pressure chambers to nozzles, respectively, and a common liquid chamber; and a step of attaching a nozzle plate having therein the nozzles to the channel plate.

37. The method of manufacturing an ink jet head of claim 35, wherein the first attachment step is a step of attaching the plurality of actuator blocks to be separated from one another so that adjacent ones of the actuator blocks partially overlap with each other with respect to a direction perpendicular to the scanning direction.

38. The method of manufacturing an ink jet head of claim 35, wherein the first attachment step is a step of arranging the plurality of actuator blocks in a staggered pattern.

39. The method of manufacturing an ink jet head of claim 35, wherein the substrate is an MgO single crystal substrate.

40. The method of manufacturing an ink jet head of claim 35, wherein the block production step includes a step of producing the piezoelectric element by sputtering.

41. The method of manufacturing an ink jet head of claim 35, wherein the block production step includes a step of layering a conductive vibration plate functioning also as the second electrode, instead of layering the second electrode.

42. An ink jet recording apparatus, comprising:

an ink jet head produced by the method of manufacturing an ink jet head of claim 35; and movement means for relatively moving the ink jet head and a recording medium with respect to each other in a scanning direction.

43. A method of manufacturing an ink jet head, comprising:

a block production step of producing a plurality of actuator blocks by sequentially layering at least a first electrode, a piezoelectric element, and a second electrode, or by sequentially layering at least a first electrode, a piezoelectric element, a second electrode, and a vibration plate, on each of a plurality of substrates each having a smaller area than that of a pressure chamber plate, which is a single plate and not an integrated plate with respect to a scanning direction;

a first attachment step of attaching the actuator blocks layered on the respective substrates to one surface of the pressure chamber plate so that some of plurality of pressure chambers provided in the pressure chamber plate are covered by the second electrode or the vibration plate of each of the actuator blocks;

a step of removing the substrates;

a step of patterning the first electrode of each of the actuator blocks; and a step of patterning the piezoelectric element of each of the actuator blocks.

44. The method of manufacturing an ink jet head of claim 43, comprising, after the step of patterning the piezoelectric element:

a step at attaching a channel plate on the other surface of the pressure chamber plate, the channel plate having therein ink channels for guiding the ink in the pressure chambers to nozzles, respectively, and a common liquid chamber; and a step of attaching a nozzle plate having therein the nozzles to the channel plate.

45. The method of manufacturing an ink jet head of claim 43, wherein the first attachment step is a step of attaching the plurality of actuator blocks to be separated from one another so that adjacent ones of the actuator blocks partially overlap with each other with respect to a direction perpendicular to the scanning direction.

46. The method of manufacturing an ink jet head of claim 43, wherein the first attachment step is a step of arranging the plurality of actuator blocks in a staggered pattern.

47. The method of manufacturing an ink jet head of claim 43, wherein the substrate is an MgO single crystal substrate.

48. The method of manufacturing an ink jet head of claim 43, wherein the block production step includes a step of producing the piezoelectric element by sputtering.

49. The method of manufacturing an ink jet head of claim 43, wherein the block production step includes a step of layering a conductive vibration plate functioning also as the second electrode, instead of layering the second electrode.

50. An ink jet recording apparatus, comprising:

an ink jet head produced by the method of manufacturing an ink jet head of claim 43; and movement means for relatively moving the ink jet head and a recording medium with respect to each other in a scanning direction.

* * * * *

UNITED STATES PATENT AND TRADEMARK OFFICE

CERTIFICATE OF CORRECTION

PATENT NO. : 6,811,248 B2
DATED : November 2, 2004
INVENTOR(S) : Hiroyuki Matsuo et al.

It is certified that error appears in the above-identified patent and that said Letters Patent is hereby corrected as shown below:

Column 17,
Line 62, “blacks” should be -- blocks --.

Column 22,
Line 6, “at” should be -- of --.

Signed and Sealed this

Ninth Day of August, 2005

JON W. DUDAS
*Director of the United States Patent and Trademark Office*